US010815115B2

(12) United States Patent
Pickett et al.

(10) Patent No.: US 10,815,115 B2
(45) Date of Patent: Oct. 27, 2020

(54) METHOD AND APPARATUS FOR CLEANING AND SANITIZING A DISPENSING INSTALLATION

(71) Applicants: Joseph S. Pickett, Galena, IL (US); Joseph S. Pickett, III, Galena, IL (US)

(72) Inventors: Joseph S. Pickett, Galena, IL (US); Joseph S. Pickett, III, Galena, IL (US)

(73) Assignee: Joseph Pickett, Galena, IL (US)

( * ) Notice: Subject to any disclaimer, the term of this patent is extended or adjusted under 35 U.S.C. 154(b) by 44 days.

(21) Appl. No.: 16/121,840

(22) Filed: Sep. 5, 2018

(65) Prior Publication Data

US 2020/0002149 A1 Jan. 2, 2020

Related U.S. Application Data

(60) Provisional application No. 62/693,133, filed on Jul. 2, 2018.

(51) Int. Cl.
*B67D 1/07* (2006.01)
*B08B 9/032* (2006.01)

(52) U.S. Cl.
CPC ..... *B67D 1/07* (2013.01); *B08B 9/0323* (2013.01); *B08B 9/0328* (2013.01); *B08B 2209/032* (2013.01); *B67D 2001/075* (2013.01)

(58) Field of Classification Search
None
See application file for complete search history.

(56) References Cited

U.S. PATENT DOCUMENTS 2,023,854 A * 12/1935 Petricone ..... B08B 9/0323 134/98.1
4,572,230 A * 2/1986 Mirabile ..... B08B 9/0325 134/166 C
5,102,312 A * 4/1992 Harvey ..... F04B 53/007 417/569
5,858,105 A * 1/1999 Pritchard ..... B08B 3/126 134/1
2008/0216876 A1* 9/2008 Lafon ..... B08B 9/0325 134/109
2010/0078046 A1* 4/2010 Labib ..... A61B 1/123 134/22.12
2015/0334979 A1* 11/2015 Roytek ..... A01K 29/00 119/651

* cited by examiner

*Primary Examiner* — Cristi J Tate-Sims
(74) *Attorney, Agent, or Firm* — Zarley Law Firm, P.L.C.

(57) ABSTRACT

The present invention relates to a cleaning and sanitizing system for a dispensing installation that uses a single pump to pull in non-caustic, non-abrasive, and non-corrosive cleaning solution, which in turn draws in ambient air. The mixture of air and liquid is discharged into a cylindrical flow controller that discharges a flow of alternating liquid cylinders and air cylinders. The air cylinders eliminate the boundary layer and laminar sublayer, which in turn allows the liquid cylinders to apply a maximum shear force associated with the hydrodynamic entry region consistently cleaning the length of the beverage or product line with mechanical cleaning and sanitizing action, which is subsequently carried away within the liquid cylinder.

20 Claims, 19 Drawing Sheets

METHOD AND APPARATUS FOR CLEANING AND SANITIZING A DISPENSING INSTALLATION

CROSS REFERENCE TO RELATED APPLICATION

This application claims the benefit of priority from Provisional Application No. 62/693,133 filed Jul. 2, 2018, the contents of this application is hereby incorporated by reference in their entirety.

BACKGROUND OF THE INVENTION

This invention is directed towards a system and method for a dispensing installation. More specifically, and without limitation, this invention relates to a system and method for cleaning and sanitizing for a dispensing installation.

Cleaning lines used for transporting beverages from a container to a customer's glass or other container are known in the art. These lines are not only used for beverages, such as beer, tea, pop (soda), but also for an array of other food products, such as condiments.

The purpose of cleaning such lines is to remove debris, biofilm, microorganisms, and other contaminants. Cleaning ensures that the taste, appearance, and overall quality and safety of a product are maintained from the site of creation to the location the item is dispensed. With particular respect, cleaning is essential to draft beers, which have gained a significant increase in attention in recent years due to the prevalence of craft and micro-breweries. As a result, the variety of beer has dramatically increased and so has the discerning taste of consumers, which has caused tens to hundreds of different brands to be on tap at a single location that must be stored away from the sale front, hundreds of feet away.

Numerous considerations are undertaken to maintain draft beer quality standards, including, but not limited to, cooler management for maintaining proper temperature, product rotation to avoid the sale of stale product, dispensing pressure monitoring to avoid introducing too much gas that can alter the taste and feel of the beer, and even the particular type of glass or other vessel that is used for a particular type of beer.

Even if all other considerations are in proper order, failure to properly clean and maintain product lines can single-handedly compromise the taste, appearance, quality, and safety of the beverage being consumed—leading to spoilage in some instances. Upon leaving a brewery, beer contained in a keg or other similar contained has the same microbiological quality as a bottled or canned beer from the same brewery. However, upon arrival, kegs that were otherwise contaminant fee are commonly contaminated after being coupled to a dispensing system—including beer contained in the keg. Contamination within a keg even occurs when a one-way valve or check valve is present. In some instances, keg contamination is the result of maintaining carbonation, which comes from the counter pressure line introducing the contaminants. Although contamination can come from a variety of locations, including the tap or tower, the most likely source of contaminants is in the product line—also known as the dispensing line.

The prevalence of contaminants is largely due to area available for adhesion and buildup of contaminants. Although "under the bar" systems are still used in select places, the vast majority of systems store kegs and other beer containers in remote locations from where they are dispensed. These "long line" or "long draw" installations use product lines that can extend over 500 feet in length. Even though the interior surface of the product lines are conventionally smooth to prevent contaminants from adhering, even the smallest of degree of contaminant adhesion leads to an exponential increase in buildup contamination.

In comparison to the amount of beer in contact with the interior surface of a keg, the surface to product ratio in long lines is magnified thousands of times when beer is drawn through the small diameter line—conventionally a 0.375 inch diameter—from the storing point to the point of dispensing. This is further amplified as beer that is not dispensed is held stagnant in the product line between servings. To place this problem into greater context, a single period or dot (".") can contain upwards of 1,300 organisms or contaminants. Approximately 41 dots can be placed along a single inch, which is over 2 million contaminants per square inch. When these numbers are considered along a length up to or in excess of 500 feet, the potential for contamination is tremendous. Thus, the need to clean and sanitize these lines is critical to maintaining the taste, feel, and quality and safety of draft beer.

Many product lines use restrictions to restrict full flow of beer and increase static pressure to maintain carbonation to provide proper foaming when dispensed. Restrictions are small diameter tubes made up of cut and folded flight or stainless steel mesh that have a smaller diameter than the product line and are positioned within the product line. The presence of restrictions increases the potential for contaminant adhesion and also increases the difficulty of cleaning the line due to restricted flow.

Unfortunately, the critical nature of maintaining product lines is inhibited by the contaminants present in lines that make cleaning and sanitizing difficult, if not impossible under some conditions.

The contamination problem begins with microorganisms that adhere to the product line. Microorganisms include yeasts, molds, bacteria, and viruses, including those undesirable microorganisms, i.e., microbial, that have a public health significance due to their decomposition of food indicative of filth or other adulterations. Other microorganisms and contaminants include hop resins, mineral crystals, protein, carbohydrates, silica gel, fibers, diatomaceous earth, sodium carbonate, and other materials, including natural products found in the composition of all beer or beer processing.

The most microorganisms are attracted to the product line by electrostatic interactions but cannot adhere due to charge repulsion. Larger microorganisms, such as yeast, are capable of overcoming the repulsion through the use of surface fimbriae that act as an anchor into the product line. Other microorganisms attach to the product line as a result of bacterial motility or passive transport caused by diffusion, gravity, and other fluid dynamic forces. As the microorganisms attach to the product line, a conditioning film is created where nutrients and microorganisms are concentrated.

The microorganisms provide protection to one another during accumulation, and eventually extracellular polymeric substance (EPS), which is a polymeric matrix that can harden, is formed that protects the adhered microorganisms as a microcolony or biofilm develops from the consortium of microorganisms adhered to the product line and embedded in the extracellular polymeric substance. The presence of extracellular polymeric substance also makes removal significantly more difficult due to stabilization of the biofilm. As a result, even if the underlying microorganisms are killed by the use of cleaning agents, the fossilized biofilm is still present and provides a site for recolonization. Consequently, the presence of biofilms in a product line is a serious problem that leads to beer having undesirable taste, particulate matter, and poor foam quality.

Although bacteria can adhere within minutes of exposure to the product line, it is believed that true biofilm development takes hours or days, or even weeks because of the cold temperatures maintained in the product lines. Once present, biofilms can retard diffusion into the biofilm thereby forming a barrier that prevents or inhibits detergents, antibiotics, disinfectants and other similar cleaning solutions from penetrating the exterior surface of the biofilm. The presence of the biofilm functions as a breeding ground that leads to exponential growth, which may only be microns thick or deep but contains millions of microorganisms.

One particular biofilm found in product lines for draft beer is beer stone, shown in FIG. 2. Similar biofilms exist in other products, such as milk stone in milk product lines. Beer stone is a uniquely structured biofilm that forms from the proteins and polypeptides in wort and beer, and also calcium and magnesium found in brewing water that form a white crystalline precipitate of calcium oxalate ($C_2CaO_2$) and protein and microorganisms. The protein in beer stone along with crystalline molecular attraction functions as a binding agent to further grow and develop the beer stone, which in turn provides a safe haven for microorganisms to prosper. The presence of beer stone in a product line can range in effect from altering the taste of beer to shortening the longevity of the beer, even to the point that beer stone can ruin an entire batch of beer causing significant monetary and time costs.

Unfortunately, beer stone is the most difficult contaminant to remove from a product line. The extremely inert calcium oxalate exterior of beer stone acts as an impermeable and virtually impenetrable structure that prevents normal cleaning agents from being effective. To make matters worse, attempts to address one composition of beer stone leads to detrimental effects from other aspects of beer stone. More particularly, nearly all cleaning methods lack mechanical action of any kind and instead rely heavily on various solutions described further herein. Sodium hydroxide, a caustic solution, is commonly employed to attack the binding proteins of beer stone through saponification that hydrolyzes the protein to form a soap. However, the use of caustic cleaners, like alkaline cleaners, leads to further precipitation and can also set the calcium present in beer stone.

Calcium oxalate is also not soluble or has very limited solubility in hot and cold water. The lack of mechanical cleaning action inhibits removal, if not making it virtually impossible. Even if the beer stone is dislodged, it must still be removed from the product line to prevent the beer stone from resuming its function as a site for contamination growth. Most employed solutions are less dense than beer stone, which makes lifting and removing the beer stone nearly impossible, especially due to the lack of mechanical action. This leads to the use of multi-step cleaning processes that are time consuming, require the use of strong acids and alkaline, and significant water consumption for rinsing. Oftentimes when a multi-step cleaning process is implemented, especially on a large scale, computer implementation is required to maintain introduction of chemicals and the duration of each step.

The American Brewers Association indicates that the proper product line cleaning procedure requires using a pump to circulate a caustic solution through the lines for at least 15 minutes with a velocity up to 2 gallons per minute or by letting the caustic solution stand for no less than 20 minutes before purging with water. Interestingly, this approach cannot properly address the presence of beer stone. Moreover, a lack of regulation and conformity has resulted in a variety of approaches that brewers, bars, pubs, and the like use to clean product lines that are equally ineffective.

Some physical approaches have been contemplated in the art. These include the use of physical obstructions pushed through a product line, such as a sponge. Other methods use ultrasonic treatment, magnetic fields, or pulsed electronic fields. All of these approaches have been lacking due to dimensional characteristics of the long lines. This is particularly true with respect to sponge methods, which are found to be unsanitary and pose a significant risk of getting lodged in lines—especially when restrictions are encountered.

Many recognized methods employ one or more of the aforementioned techniques with varying degrees of success, such as "pot cleaning" utilizing a static liquid cleaning compound which is then pushed, which is usually done with carbon dioxide, air, gas, or water. Pot cleaning techniques produce an undesired effect due to reactions with the chemical solution and rinsing agents that lead to further precipitation that further accumulate on present biofilm.

Tremendous focus is still placed on the development of an effective chemical composition for cleaning and removing contaminants in a line.

The attention on chemical composition is, at least partially, misguided due to a lack of mechanical action. Other problems also exist. For instance, the use of detergents make rinsing difficult and can lead to residue that can be harmful or lethal as discussed further in the following.

Almost all compositions use some amount of a strong acid and alkali for treating proteins and calcium found in the product line. These compositions, which can include very dangerous strong acids like nitric acid, also often require multiple steps. Additionally, temperatures must vary based on the type of chemical composition being introduced—hot for caustics, lower for alkali, and cold for disinfectants. Not only are these temperatures difficult to maintain, but the use of colder temperatures, such as those for disinfectants have been found to be ineffective in biofilm removal. Furthermore, the bundling of product lines has made the use of elevated temperatures inefficient and ineffective as not all lines are in use and therefore do not need to be cleaned. Also, as noted, these chemicals lack sufficient density to remove the insoluble and impermeable contaminants found in a product line, even if temporarily removed. This leads to recolonization that only increases in rate throughout the life of a product line.

It is well known that chemical action by itself is insufficient for cleaning a line. Cleaning, which is accomplished using a cleaning agent, mechanical action, or other means involves the process of removing food and other types of contaminants, including biofilm from the surface of the product line. Without effective cleaning it is nearly impossible to sanitize thereafter. Sanitizing means adequately treating surfaces by eliminating the presence of microorganisms and reducing the number of microorganisms present in a product line without affecting the beer, or other beverage or product, while maintaining safe conditions for a customer. Mechanical action is critical to both cleaning and sanitizing, as mechanical action removes biofilms, contaminants, and abiotic materials and debris, while increasing chemical penetration, and decreasing surface tension.

Due to numerous difficulties associated with the mechanical action of current methods, more abrasive, caustic, and corrosive chemicals are used to overcome these deficiencies.

In addition to being hazardous to those cleaning the product lines, these solutions can be deadly to customers when they are served with what is referred to as a "hot beer." A hot beer is poured when the caustic cleaning solutions are accidentally poured into a customer's glass. The presence of these materials can be residual because of inadequate rinsing or be more substantially concentrated if a line being cleaned is dispensed into a glass.

Upon consumption of a hot beer the nature and degree of the harm is apparent almost immediately. In some cases, the customer who consumes the hot beer will almost immediately attempt to remove the chemicals by vomiting. The internal burns caused by the hot beer then leads to the customer vomiting blood. Internally, the burns extend from the person's mouth and into their stomach, which in some cases requires removal of the damaged organs. The degree of the chemical burns are so significant that drinking or eating afterwards is nearly impossible due to damage and sensitivity of the lining of the stomach and esophagus. In some cases, the customer must have an induced coma to be treated. The potential for lethality is incredibly high as well. Likewise, the liability of the brewer, restaurateur, and cleaning in some situations is equally tremendous in addition to the substantial losses of goodwill from the public. Though referred to as hot beer, similar occurrences can take place with water, tea, beer, and other beverages and condiments.

In attempts to overcome the lack of mechanical action found in pot cleaning approaches, a variety of flows have been tried. Each, however, suffers from significant deficiencies, while failing to eliminate the of use potentially deadly chemical solutions.

One of the more common approaches is the circulation of liquid through a line, much like that suggested by the Brewers Association. Liquid flows, however, lack the required velocity for applying a sufficient shear force by the liquid onto the interior of the product line—shear force or shear stress refers to a force that pushes a part of a body in a particular direction while pushing another part of the body in an opposite direction; compared to compressive forces that push different parts of a body towards each other. The insufficient velocity is due to the presence of a boundary layer and a laminar sublayer in the fully developed region of liquid flow.

At low speeds, the flow of the liquid is laminar, meaning that the entire flow of the pipe is laminar as the fluid slides over itself, thereby failing to apply a shear force to the surface of the product line. Even at higher velocities, laminar properties are present along the interior surface of the product line.

The flow consists of various layers that within each layer is a linear, axial flow direction with respect to a center axis of a line, which flows at a different rate than the other layers. It is understood that conventionally the liquid near the center of the flow will travel most rapidly while the velocity at the outermost part of the flow will have a velocity of zero or near zero. This reduction in flow rate is why liquid flows have a parabolic profile shortly after entry.

The distinction in velocity is due to the outermost layer or laminar sublayer, which is very close to the interior surface of the product line, having a laminar flow that is caused by friction between the interior surface of the product line—which although generally smooth still contains elements that have a roughness, including the product line itself and contaminants—and the laminar sublayer that causes a drag on the flow. As a result of the laminar flow at the laminar sublayer, the surface of the pipe is essentially protected from shear forces and mechanical cleaning action as the rest of the liquid slides over itself.

The exact size of the laminar sublayer is dependent on overall conditions of the flow and liquid, including the velocity, viscosity, and density. As such, the thickness or depth of the laminar sublayer can vary from tenths of a millimeter to several millimeters.

The laminar sublayer is part of a boundary layer or liquid boundary layer that extends from the zone from the base of the flow to the depth where the average flow speed is reached. The boundary layer is the zone of the flow that experiences slower velocities caused by the laminar sublayer, but is much larger than the laminar sublayer. Further away from the interior surface of the product line and the laminar sublayer, the flow is turbulent with sufficient velocity. In this area, there are eddies and vortices of liquid, but the influence of these aspects on the flow are rendered useless because of the boundary layer and laminar sublayer. The use of small diameter lines, such as those found in beer product lines, further limits the effectiveness of liquid flow because there is insufficient space for these formations to form. Due to these limitations of liquid flow, there is significant dependence on long cleaning times and the use of highly acidic or basic chemicals.

On the other side of the flow spectrum are air or gas flow systems and methods. Although these systems are capable of very high velocities, the lack of viscosity prevents air flow systems from creating the necessary shear force to clean and sanitize a product line.

A variety of other approaches attempt to utilize a mixed phase flow of gas and liquid to create a mixed phase flow in an attempt to overcome the deficiencies present in an only air flow or an only liquid flow. The purpose of these systems is to create a turbulent flow that is chaotic and forms wakes, vortices, and eddies, which inherently make accurately tracking the flow rate impossible.

With reference to FIGS. 11A-11B, one range of these flows involves liquid with little gas. At a low velocity, elongated bubble flows are formed, which in a horizontal flow has small, yet elongated profile at the top of the flow and vertically results in larger dispersed bubbles. As velocity increases, the bubbles decrease in size and increase in number due to the turbulent flow thereby forming a bubble flow. In a horizontal flow the bubbles are dispersed with a greater concentration near the top of the flow due to gravity and buoyancy and in a vertical flow the bubbles are almost homogeneously mixed throughout the flow. In both the elongated bubble flow and the bubble flow, the product line wets the exterior surface and thereby forms a laminar layer of protection that prevents the application of sufficient shear force to remove biofilm, microorganisms, and other contaminants. With respect to the areas with bubbles, a bubble is still viewed as gas that is substantially surrounded by liquid, such that the gas does not extend in all directions to the exterior surface of the line, i.e., does not completely interrupt the flow of liquid in the tube. The presence of this liquid is known as slippage, as the liquid around the bubble engages the product line forming a boundary layer. These flows are ineffective flows for sufficient mechanical action.

As gas volume increases to nearer to equal ratios with the liquid, and at low velocity, the flow is stratified due to buoyancy and gravity thereby forming clearly distinct regions of liquid that extend along the bottom of the flow and air that extends along the top of the flow. In stratified flow, only the bottom of the flow is in contact with liquid, which provides worse cleaning action than a liquid flow, the gas flow region along the top of the stratified flow is moving at a slow velocity and also lacks viscosity to provide mechanical action.

As velocity increases, the stratified flow becomes a plug flow or a slug flow. In a horizontal flow, slug flow is present when there are intermittent regions of liquid with entrapped bubble, or regions of liquid in gas. In a horizontal plug flow there are intermittent regions of full liquid, or regions of gas and liquid. Both plug and slug flow have very large bubbles that flow within liquid. Each of these flows also experience slippage. Another deficiency of these flows is that plug and slug flow cannot be maintained at elbows due to a change in velocity and density.

Other flows exist that suffer some or all of these deficiencies. For instance, a Taylor flow is present when liquid encircles a cylinder of air that takes on a similar shape of a donut when viewed as a cross section. A churn flow is a chaotic flow present in vertical flows that results from instability on the outside of a cylinder found in a Taylor flow. With these characteristics it is apparent that a boundary layer is present in a Taylor flow and slippage is occurring in a churn flow where the chaotic properties are taking place.

The presence of a boundary layer and the related laminar sublayer present from the flow or as a result of slippage renders mechanical action for cleaning and sanitizing a line impossible. In the event that contaminants are dislodged, many of the flows lack the velocity requisite to remove the debris from the product line, which leads to reattachment and recolonization. Therefore there is a need for a mechanical action to work on the interior surface of the line and subsequently remove the mechanically removed contaminants.

When the volume of gas is raised further to function more predominantly as an airflow system with little liquid present annular flow occurs at relatively lower velocities. In an annular flow in an upward vertical flow, the liquid extends around the tube with a few drops suspended in the gas positioned in the middle of the liquid, which as a result leads to the presence of a liquid boundary layer that prevents mechanical cleaning. In a horizontal annular flow, the majority of the liquid flows at the bottom but is still sufficiently present to provide a laminar sublayer.

In a wispy flow, also known as a semi-annular flow, the vertical flow of a liquid is substantially the same along the interior surface of the product line, but within the core of the flow the number of droplets is increased, which leads to strand formation of liquid. As such, the deficiencies of a wispy flow are much the same as an annular flow.

All of these flows suffer similar or related deficiencies, which results in the absence of a mechanical action. As a result, the use of chemical solutions is necessary. Counter-intuitively, however, these chemical solutions also further reduce shear forces necessary for mechanical action by reducing surface tension of the liquid. Additionally, there is always the risk that too little solution will be used, which is ineffective, or too much will be used, which is wasteful, inefficient, and increases the risk of residue remaining that could harm the quality of the beer or the customer.

Each of these methods also require the use of a volumetric pump that imparts pulsation or hydraulic shock to the flow that destabilizes or disrupts normal flow. Some methods seek to benefit from the resulting turbulence, for instance, in pulse flow that uses unsteady flows with changing pressure and velocity at certain time intervals. However, pulsation does not remove the laminar sublayer and ultimately leads to inconsistent application of the system's method.

One improvement in the art directed at imparting mechanical action to cleaning and sanitizing a line is a high air velocity and low volume liquid system that forms a high velocity mist or droplet flow—as disclosed in U.S. Ser. No. 10/197,287 (Labib). In this high velocity droplet flow, liquid in the amount of 200-1000 drops of liquid, or less than 100 mL, is introduced, pushed through, and circulated by an air compressor or blower at that provides high velocity air traveling between 40 to 100 m/s. The liquid is maintained at a ratio of air to liquid of 50:1-6000:1. If greater amounts of liquid were present, the physical restrictions in the line, along with restrictions imposed by industry regulations, would make operation at 40 m/s and above impossible.

The principle behind this flow is that the droplets in the air will be traveling at such a high velocity through the line that upon impact with debris on the interior surface of the product line will provide sufficient shear force to mechanically clean the product. Once impacted, the liquid will entrain onto the interior surface, but the high air velocity, and a turbulent and pulsating flow, will remove or pull additional droplets off to reimpact.

This flow suffers from a myriad of deficiencies. To begin, there is the potential that either too much or too little liquid will be added. If too little is added, the droplets may be too small and there will be insufficient impact to create the necessary shear force for mechanical action—if liquid is severely deficient, there is the possibly that no droplets will form at all. If too much liquid is added the flow essentially becomes a slug flow and has all of the related problems. If an appropriate amount of water is added, the size of the droplet formed and the air flow velocity must be monitored closely to ensure requisite shear force is achieved. As such, a flow meter must be positioned upstream from the mixture of air and liquid.

Even when a droplet impacts the interior surface, any mechanical action that occurs takes place on an immensely small fraction of the product line. The site of the impact is also entirely random with the effectiveness of the flow performing best at the entrance and exit of the line. As such, this flow would require an excessively long run time to possibly clean the entire line as the random nature of the impacts makes it impossible to know if all areas have been cleaned. Any areas that are not cleaned remain prime areas for recolonization.

The inefficiency of this flow is further demonstrated by the need to enhance the flow by way of additional chemical solutions. Cleaning solutions that include solid particles are suggested as the particles can enhance the force of the impact, but if any particles are left behind they provide another source to colonize or be removed thereafter while beer is being poured for a customer. If the product lines have a small diameter, surfactants are used to facilitate droplet formation, however, the use of surfactants lowers shear force.

One other flow that is believed capable of imparting sufficient shear force for mechanical action is film flow. In film flow, suds are introduced in the product line in a variety of ways and when impacted it is believed sufficient shear force will occur. The random nature of this approach has its inherent drawbacks with respect to control and effectiveness, which are further amplified by its limited application to long lines that make formation of suds throughout the line impractical and can lead to restricted flow. Moreover, the film is essentially a bubble that has some degree of slippage.

Currently, no system or method is available in the art that effectively cleans and sanitizes a product line by penetrating the critical boundary layer within the product line and thereafter removes the contaminants completely from the product line. As a result, there is a need to clean and sanitize a dispensing installation that improves upon and overcomes the problems presented by existing systems that is fast, versatile, and effective on all product lines.

Thus it is a primary objective of this invention to provide a system and method for cleaning and sanitizing a dispensing installation line that improves upon the art.

Another objective of this invention is to provide mechanical cleaning action capable of removing contaminants, including beer stone.

Yet another objective of this invention is to provide a liquid flow that maintains the hydrodynamic entry region throughout circulation, as well as the related shear force in a continuous and persistent manner.

Another objective of this invention is to provide a flow that is not a mixed flow but an alternating flow of liquid and air cylinders.

Yet another objective of this invention is to provide a device for separating a mixed flow into distinct cylinders of liquid and air.

Another objective of this invention is to provide a flow that has mechanical action in horizontal and vertical flows, regardless of flow action, including through transitions in a product line.

Yet another objective of this invention is to provide a flow that does not require forced air or gas, or energy from air or gas.

Another objective of this invention is to provide a flow that utilizes ambient or atmospheric air.

Yet another objective of this invention is to provide a single-step process for cleaning.

Another objective of this invention is to provide a system that does not use caustic solutions and other potentially life-threatening compositions.

Yet another objective of this invention is to provide a system that works on a single product line from a front end or back end, or on multiple lines.

Another objective of this invention is to provide a system that is quiet, safe, lightweight, potentially mobile, cost effective, and easy to use.

Yet another objective of this invention is to provide a system that maintains beer quality and safety.

These and other objectives, features, and advantages of the invention will become apparent from the specification and claims.

BRIEF SUMMARY OF THE INVENTION

In general, the present invention relates to a system and method for cleaning and sanitizing a dispensing installation. The present invention uses a single pump to pull in non-caustic, non-abrasive, and non-corrosive cleaning solution, which in turn draws in an air source, which is ambient air in the exemplary embodiment. No modification of the ambient air is necessary beyond filtration of particulate matter that may add contaminants to the system. As such, there is no control of the air with respect to temperature, pressure, or humidity. Also there is no need for a separate air compressor or blower because the ambient air does not add energy to the flow of the system. Thus, in some embodiments the source of air is positioned on a suction side of the pump, but in others is positioned on the discharge side, such that gas is drawn in by the discharged liquid and not directly by the suction forces of the pump.

A cylindrical flow controller slows the mixture of air and liquid pumped through the system, which allows the separation of the air and liquid from one another. This in turn leads to the discharge of substantially uniform and alternating cylinders of liquid and cylinders of gas with each extending to the complete annular interior surface of the product line upon discharge. This is possible due to headspace in the cylindrical flow controller.

In a normal liquid flow, there is a short-lived hydrodynamic entry region present when the liquid is initially introduced to a product line as shown in FIGS. 12A-12C. Due to contact with the product line and other sources of drag, a boundary layer and laminar sublayer are formed that slows or stops the flow near the interior surface. This results in the hydrodynamic entry region, which has the maximum shear force of the liquid flow, to transform into a fully developed region, which has limited to no shear force applied to the interior surface of the product line. Hence, without shear force, no mechanical action can be applied to contaminants on the interior surface of the product wall.

In contrast, the alternating liquid cylinders and air cylinders of the present invention prevent transition to the fully developed region of a conventional liquid flow. Instead, each air cylinder eliminates any boundary layer and laminar sublayer of the preceding liquid cylinder. This allows the proceeding liquid cylinder to maintain the hydrodynamic entry region and the associated maximum shear force throughout circulation. In addition, the limited distance between liquid cylinders and air cylinders prevents sufficient drag from occurring that would cause the rear portion of the liquid cylinder to enter the fully developed region.

The alternating uniform liquid cylinders and air cylinders are pumped through the dispensing installation with the liquid being discharged back into the reservoir for recirculation or a waste container in a front end configuration, back end configuration, and back and front end configuration at a high rate. During cleaning cycles, mechanical action, which is continuously applied by a maximum shear force up to 100 fold of other conventional systems, is applied to the entire interior surface of the product line thousands of times. Removed contaminants, including microorganisms and biofilms, are subsequently carried away within the liquid cylinder. Filters in the system prevent contamination at multiple points throughout the system thereby increasing the cleaning and sanitizing efficiency of the system, limiting recolonization, and reducing wear on the system including the pump.

As a result, non-caustic, non-corrosive, non-abrasive cleaning solution, including the use of only water or a mixture of ethylenediaminetetraacetic acid (EDTA) or sodium citrate, a low concentration of hydrogen peroxide, and substantially neutral alkali can be used instead of hazardous chemical solutions.

DETAILED DESCRIPTION

Figure 1:
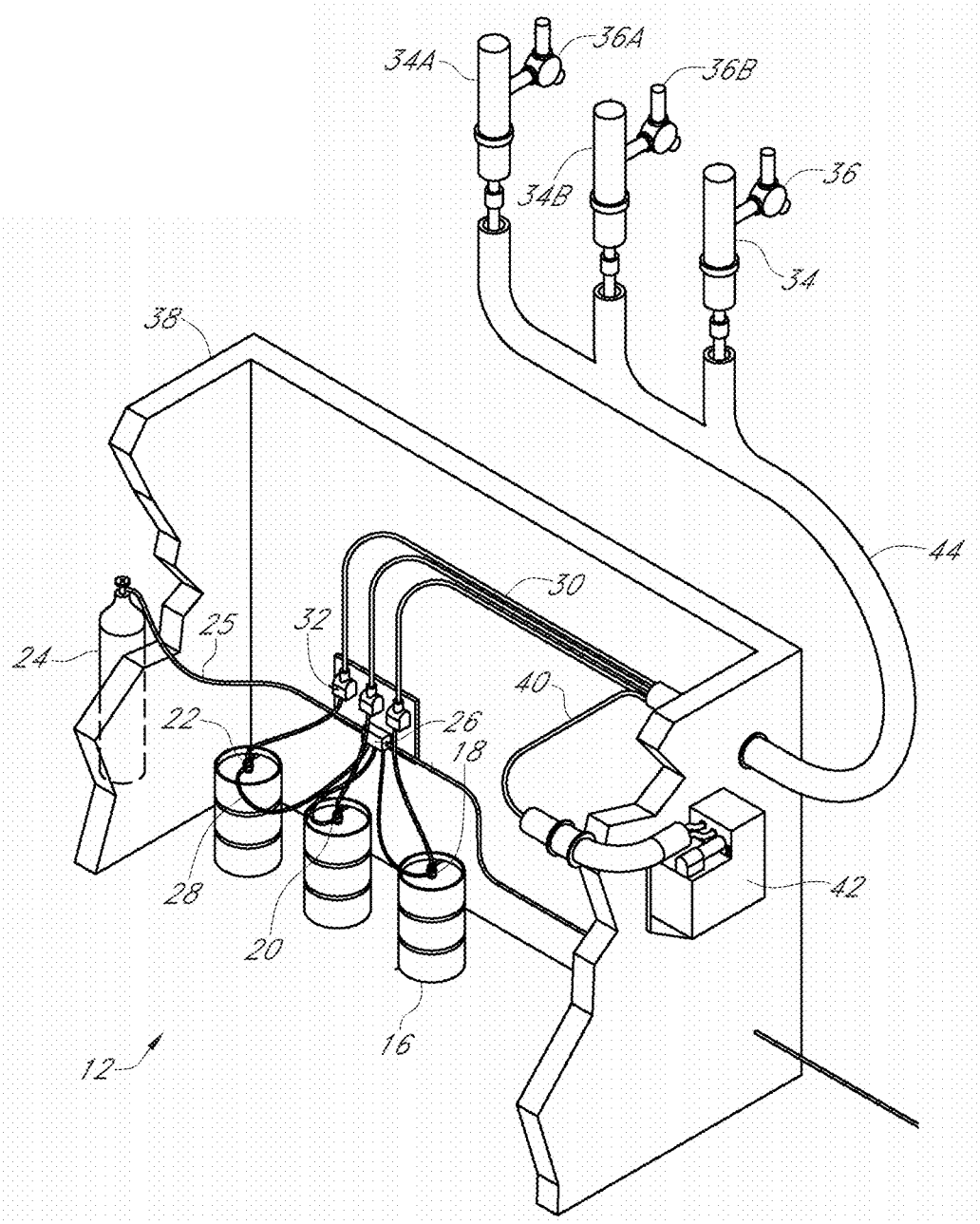
FIG. 1. is a perspective view of a conventional beverage dispensing system.
Figure 2:
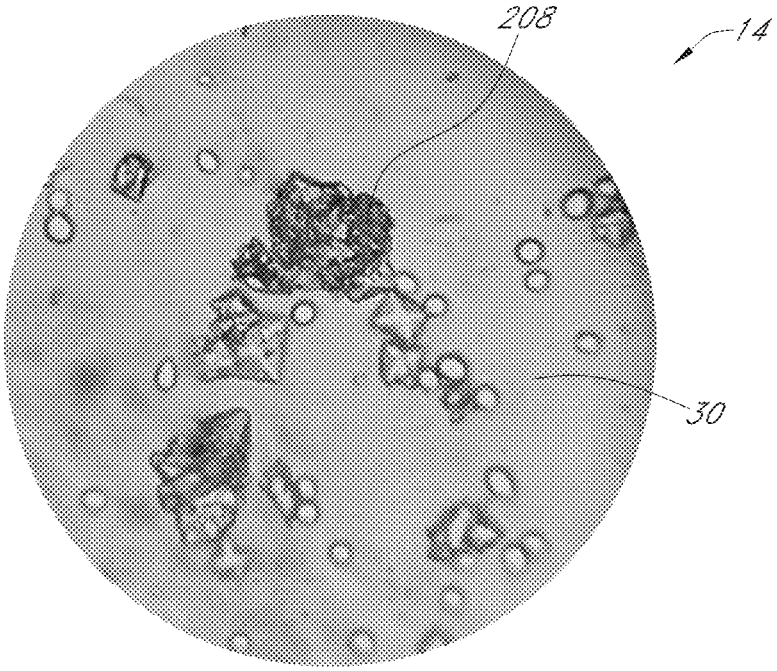
FIG. 2 is a top view of a beer stone formation.

With reference to the Figures a cleaning and sanitizing system 10 and method for cleaning and sanitizing a beverage storage and dispensing installation 12 is provided, and as shown in the exemplary embodiment the beverage storage and dispensing installation 12 is used for the storage and dispensing of draft beer. Other storage and dispensing installations 12 are contemplated, however, including soda, wine, liquor, juice, and other beverages and condiments. In general, the system 10 is applicable for use in other fields where the product being transported is capable of depositing a biofilm 14 and other contaminants, such as industrial applications like chemical transport, agricultural applications like feed and dairy transport, and commercial applications like car washes.

The typical beverage storage and dispensing installation 12 includes one or more beverage containers or reservoirs, such as a keg 16. The keg 16 is connected to a tavern head or keg coupler 18, which also has a gas line connector 20 and a product line connector 22.

A gas container 24 is connected to the gas line connector 20 by a gas pressure line 25 that runs from the gas container 24 to a gas distribution center 26 and through to the gas line connector 20 by a counter gas pressure line 28. The gas container 24 provides pressurized gas, such as carbon dioxide ($CO_2$), to the beverage to maintain pressure and carbonation.

In some arrangements, a product line 30 extends from the product line connector 22 to a beer pump 32 that pumps the beer from the keg 16 to a tower head or dispensing station 34 that dispenses the beer through a spigot 36. In other arrangements, no beer pump 32 is present and the pressure from the gas container 24 is relied upon to transport the beer from the keg 16 to the tower head 34. The product line 30 length can vary based on the particular dispensing installation 12, but in large establishments, it is common for the length of the product line to be between 100 and 500 feet and have vertical portions that extend 6 to 20 feet to run underground or go over or through a wall 38 resulting in up and down vertical flows in addition to horizontal flows.

To keep the beer stored in the product line 30 cold for consumption, a glycol cooling line 40 is run with the product line 30 that transports refrigerant pumped from a glycol cooling unit 42. It is common to bundle the glycol cooling line 40 and one more product lines 30 together in a line bundle 44 to simplify installation.

The cleaning and sanitizing system 10 is positioned within a housing 46 that in some embodiments is mounted on a wheeled cart 48 (not shown) that allows the system 10 to be mobile for use at multiple sites or for storage. Alternatively, the system 10 is mounted within an establishment with or without a housing 46. In one embodiment the housing 46 has a height of approximately 10.0 inches, a length of approximately 12.0 to 13.0 inches, and a width of approximately 10.0 inches.

The cleaning and sanitizing system 10 has a liquid inlet line 50 that extends between a first end 52A and a second end 52B and in some arrangements has a diameter of 0.375 inches, which is a common dimension in the draft beer field. The first end 52A of the liquid inlet line 50 is connected to and in communication with a reservoir 54 that is a bucket, canister, container, or any suitable device capable of holding a liquid. Adjacent the first end 52A is a filter 56 to remove particulate matter that could be present in the liquid or as the result of recirculation.

The liquid inlet line 50 goes through an inlet port 58 on the housing and into an interior 60 of the housing 46. The second end 52B of the liquid inlet line 50 connects to a liquid flow meter 62 by a first or bottom port 64A. The liquid flow meter 62, which is positioned on an exterior surface 66 of the housing 46 to be readily viewable, and controls and monitors the rate of liquid flow with a needle valve 68 (not shown). In some arrangements of the present invention, the bottom port 64A of the liquid flow meter 62 is also positioned on an exterior surface 66 of the housing 46 that eliminates the need for the inlet port 58.

A liquid discharge line 70 extends between a first end 72A and a second end 72B with the first end 72A connected to a second or top port 64B of the liquid flow meter 62. As seen in the exemplary embodiment, the second end 72B of the liquid discharge line 70 is connected to a first T-adapter 74.

An air flow meter 76 having a first or bottom port 78A and a second or top port 78B. The air flow meter 76 is positioned on the exterior surface 66 of the housing 46 as well to be readily viewable, and controls and monitors the rate of air flow into the cleaning and sanitizing system 10. As shown in the exemplary embodiment, the bottom port 78A is not connected to a line of any kind, but instead is exposed to draw in atmospheric or ambient air from the surrounding environment without the need of a blower or air compressor as detailed further herein. In some arrangements, a filter 80 is positioned in or adjacent to the bottom port 78A to remove contaminants from the air, which is important because a high number of bacteria capable of spoiling beer have been found to come from contaminated air. In some arrangements of the present invention, the bottom port 78A is also positioned on an exterior surface 66 of the housing 46 to facilitate access to ambient air without the risk of creating a vacuum within the interior 60 of the housing 46.

An air discharge line 82 that extends from a first end 84A to a second end 84B is connected to the top port 78B of the air flow meter 76. The second end 84B is connected to the first T-adapter 74 in substantially perpendicular alignment with the connection of the liquid discharge line 70. Between the first end 84A and second end 84B is a check valve 85 that prevents liquid from the liquid suction line 76 passing through the first T-adapter 74 and backing up into the air discharge line 82 to the air flow meter 76.

A pump suction line 86 extends from a first end 88A and a second end 88B, with the first end 78A connected to the first T-adapter 74 opposite to and in substantially parallel alignment with the second end 72B of the liquid discharge line 70 and substantially perpendicular alignment with the second end 84B of the air discharge line 82. In some embodiments, the liquid discharge line 70, the air discharge line 82, and the pump suction line 86 are a single line that is forked.

The second end 88B of the pump suction line 76 connects a suction side or suction port 90 of a pump 92. In some embodiments, a filter 94 is positioned in the suction port 90 or adjacent the suction port 90 in the second end 88B of the pump suction line 76 to prevent contaminants from entering the pump 92 and circulating and simultaneously limiting wear and extending the life of the pump 92.

In the exemplary embodiment, the pump 92 is a positive displacement pump with a constant flow rate, but other pumps 92 are contemplated including variable flow pumps. The pump 92 is connected to a power source 96 such as an outlet or battery. The pump 92 is configured to receive a mixture of liquid and air on the suction side 90 and pressurize and compress the mixture to 60 PSIG, which is the maximum permitted by safety regulation—absent those safety regulations, configurations with higher PSIG are contemplated.

A pump discharge line 98 that extends between a first end 100A and a second end 100B is connected to a discharge side or discharge port 102 of the pump 92 at the first end 100A. The second end 100B of the pump discharge line 98 is connected to a cylindrical flow controller 104.

In some embodiments, the air discharge line 82 is connected to the pump discharge line 98 rather than the first T-adapter 74, such that ambient air is pulled by liquid discharged from the pump 92. In this way, the pump 92 does not act directly to draw in air, but rather air is drawn in by the liquid.

The cylindrical flow controller 104 has a hollow elongated body 106 that has a sidewall 108 that extends from a top 110 and a bottom 112 with an internal cavity 114 therein. In the exemplary embodiment the elongated body 106 is cylindrical but other shapes are considered, but as shown, the elongated body has a width that is larger than the diameter of the pump discharge line 98. In one embodiment the length from top 110 to bottom 112 is approximately 9.5 inches and the internal cavity 114 has a 1.0 inch diameter between the sidewall 108.

The elongated body 106 has a cylinder outlet port or top port 116, a pressurized liquid outlet or bottom port 118, and an inlet port or middle port 120 that is positioned between the top port 116 and the bottom port 118. To facilitate flow, the middle port 120 is on the opposite side of sidewall 108 of the elongated body 106 with respect to the top port 116. The top port 116 is set off below the top 110 such that there is a headspace 122 in the internal cavity 114 above the top port 116. The bottom port 118 is positioned at the bottom 112 and extends from the sidewall 108 as shown in the exemplary embodiment, but extends downwards from the bottom 112 in other embodiments.

A pressurized liquid line 124 that extends from a first end 126A to a second end 126B with the first end 126A is connected to the bottom port 118 and the second end 126B is connected to a pressure relief valve 128 at an inlet port 130. The pressure relief valve 128 has a set point to open if the liquid pressure going through the pressurized liquid line 124 exceed 60 PSIG in accordance with safety regulations.

Connected to an outlet port or bypass 132 of the pressure relief valve is a first end 134A of a pressure relief line 136. The second end 134B of the pressure relief line 136 goes through a pressure relief port 138 in the housing 46 and back into the liquid reservoir 54, or a waste container 140 in other embodiments. In an alternative arrangement, the second end 134B is connected to the liquid inlet line 50 or the liquid discharge line 70 to allow for a shorter line and faster recirculation. A filter 142 is inserted into the pressure relief line 136 to limit misting upon return to the liquid reservoir 54 and to remove any contaminants that could be present.

A cylinder discharge line 144 that has a first end 146A and a second end 146B is connected to the top port 116 of the cylindrical form controller 104 at the first end 146A. Between the first end 146A and the second end 146B is a first portion 148 and a second portion 150 of the cylinder discharge line 144. Positioned between and connected to the first portion 148 and the section portion 150 is a second T-shaped adapter 152 such that the first portion 148 and second portion 150 are connected in substantially parallel alignment.

Also connected to the second T-shaped adapter 152 is a pressure gauge line 154 that extends from a first end 156A to a second end 156B with the first end 156A connected to the second T-shaped adapter 152 in substantially perpendicular alignment with the cylinder discharge line 144. In other arrangements the cylinder discharge line 144 and the pressure gauge line 154 are a single line that is forked.

The second end 1568 is connected to a pressure gauge 158 that displays the pressure of the cleaning and sanitizing system 10 after discharge from the pump 92, as well as the dispensing installation 12. The pressure gauge 158 is positioned on the exterior surface 66 of the housing 46 in some embodiments, and in other embodiments is within the interior 60 of the housing 46 and the current pressure is in communication to a remote device 160 (not shown), such as a cell phone or laptop either directly or through a network, including the Internet.

Figure 3:
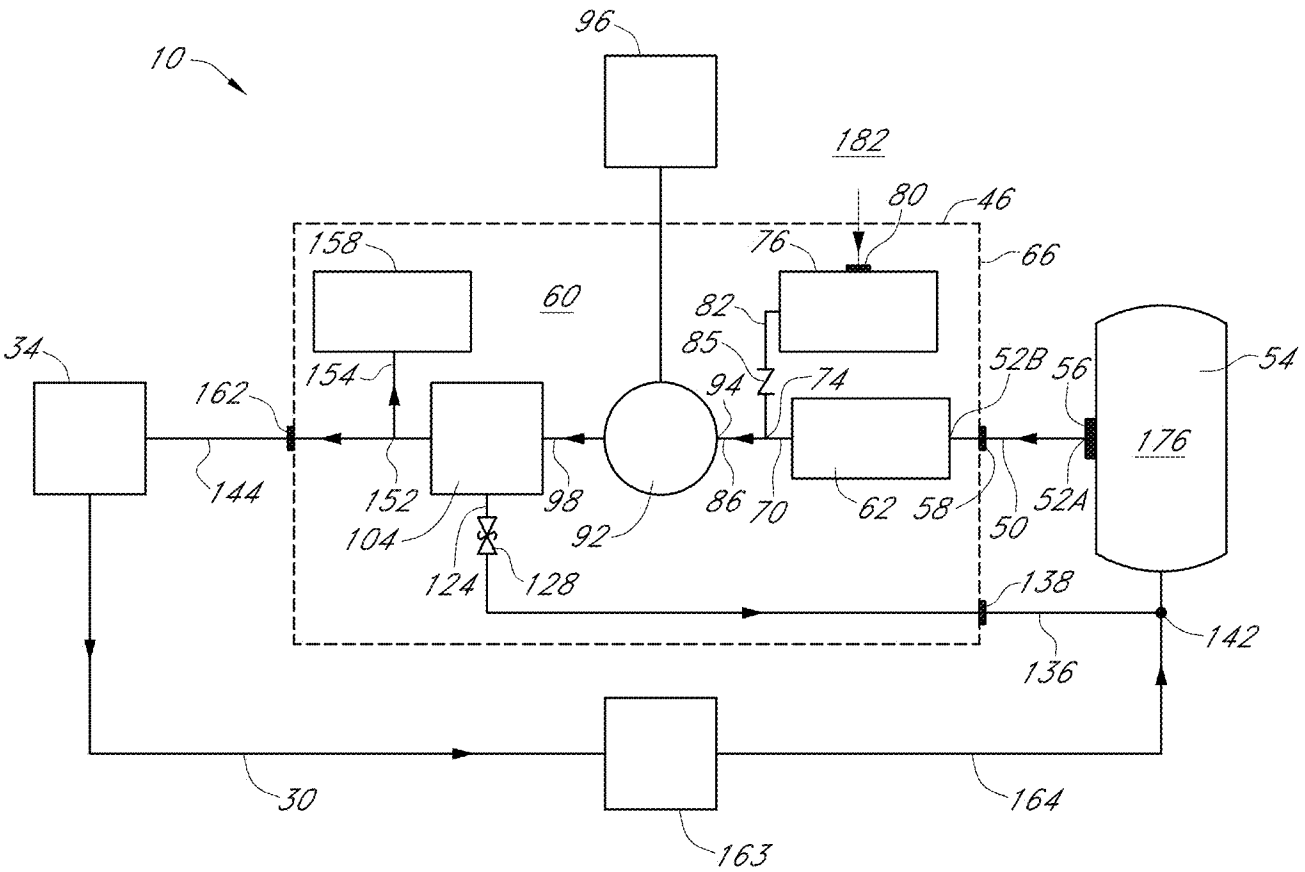
FIG. 3 is a schematic view of a system and method for cleaning and sanitizing a dispensing installation in a front end configuration.
Figure 4:
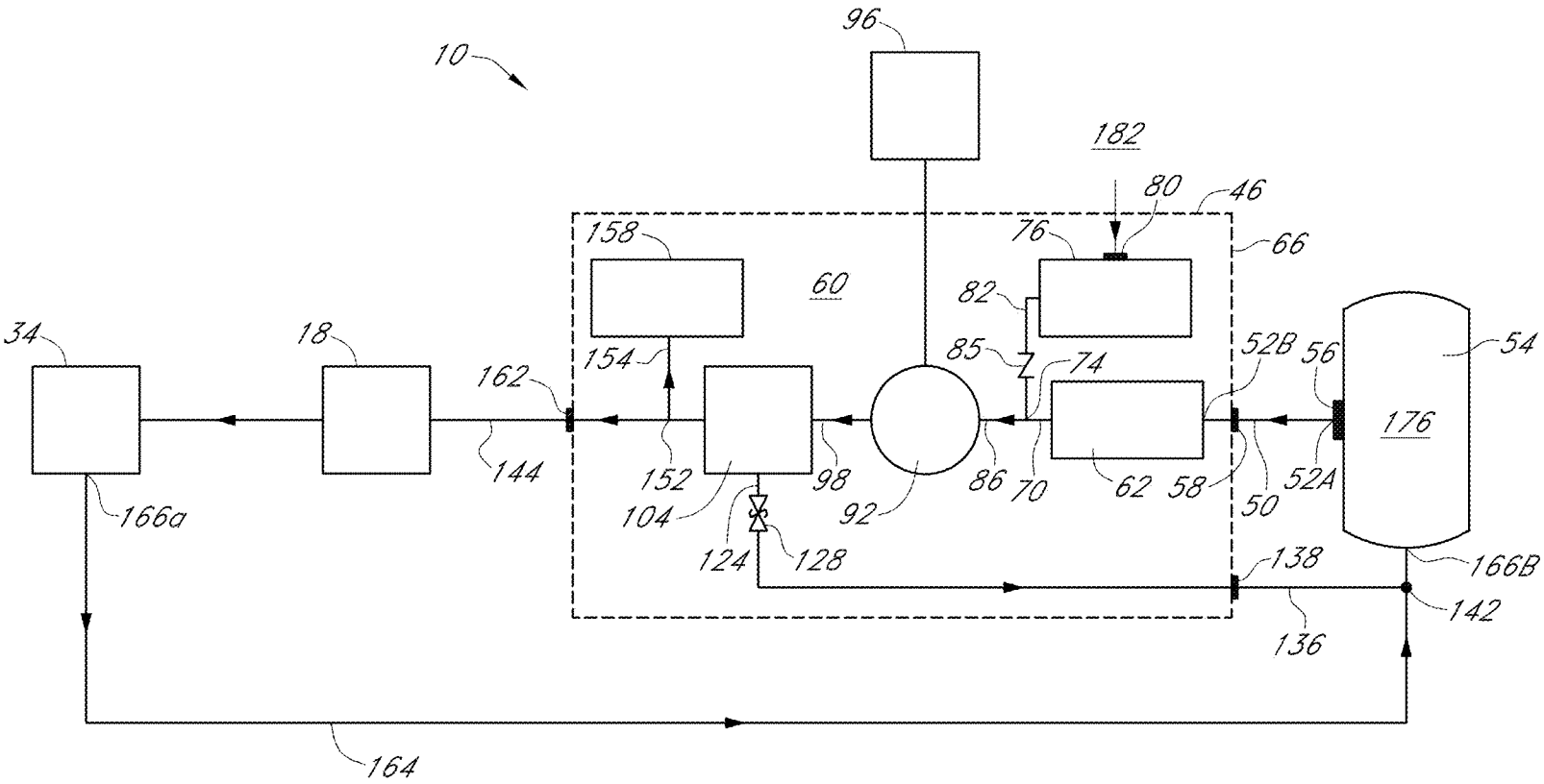
FIG. 4 is a schematic view of a system and method for cleaning and sanitizing a dispensing installation in a back end configuration.
Figure 5:
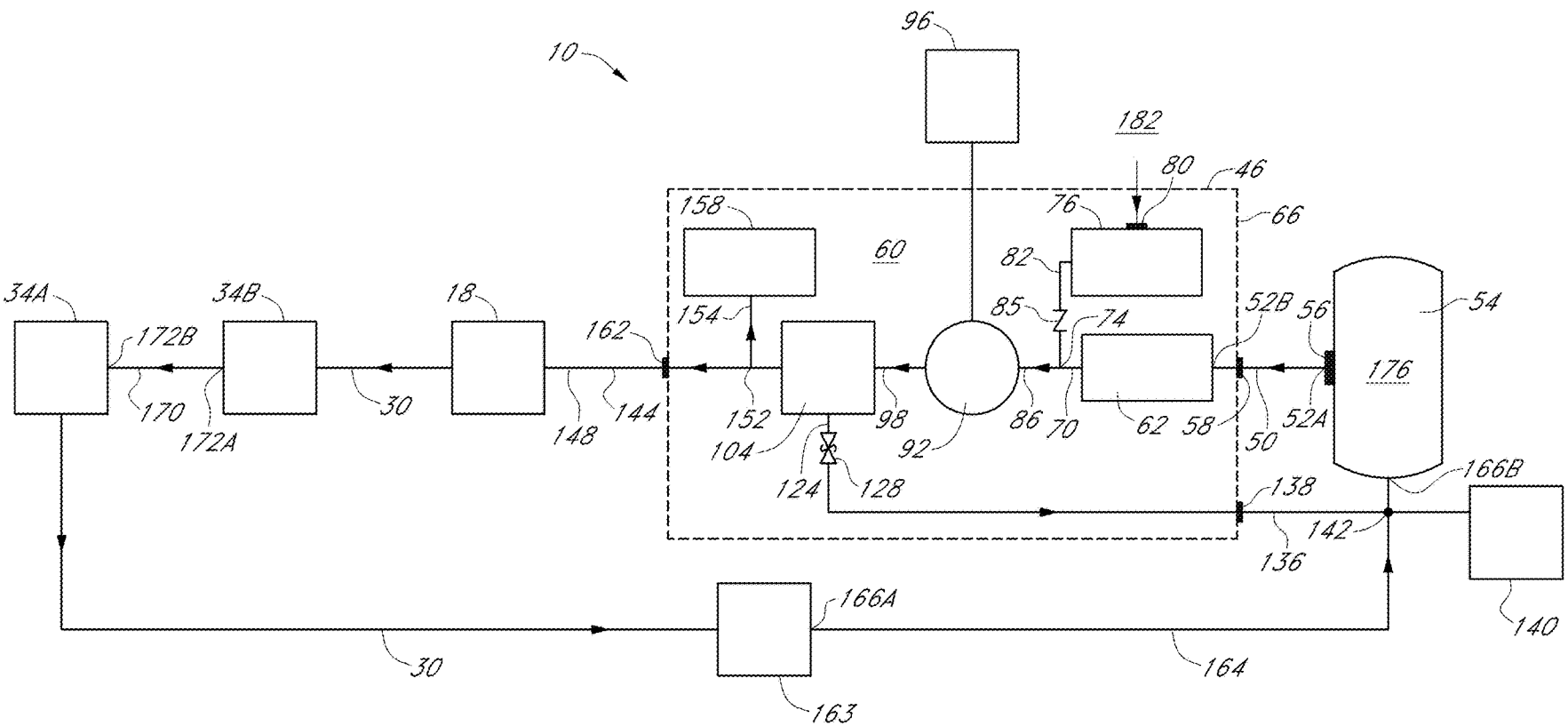
FIG. 5 is a schematic view of a system and method for cleaning and sanitizing a dispensing installation in a back and front end configuration.

The second end 146B of the cylinder discharge line 144 goes through an outlet port 162 in the housing 46 and is connected to the dispensing installation 12. The cleaning and sanitizing system 10 is configured to connect to the dispensing installation 12 in a variety of ways, including a front end configuration as exemplified in FIG. 3, a back end configuration as exemplified in FIG. 4, and in a back and front configuration as exemplified in FIG. 5.

In the front end configuration, the second end 146B of the cylinder discharge line 144 is connected to the spigot 36 at the tower head 34, or to the tower head 34 directly. In this configuration, the product line 30 is connected to a first end 160A of a return line connector 163. A return line 164 that extends from a first end 166A to a second end 1668 connected to a second end 160B of the return line connector 163 with the first end 166A. The second end 166B of the return line 164 is connected to or in communication with the liquid reservoir 54 for recirculation, or in some embodiments, is connected to or in communication with the waste container 140. A filter 168 is positioned in the return line 164 near the second end 166B to demist the discharge back into the reservoir 54 or waste container 140 to limit the possibility of recontamination. In alternative arrangements, the product line 30 is connected to or in communication with the liquid reservoir 54 or waste container 140 without the presence of the return line connector 163 and the return line 164.

In the back end configuration, the second end 146B of the cylinder discharge line 144 is connected to the keg coupler 18 in the same manner that the keg 16 connects to the keg coupler 18. As such, the keg 16 must be removed prior to connecting the cylinder discharge line 144 to the keg coupler 18. The first end 166B of the return line 164 is connected to the spigot 36, or directly to the tower head 34 in other arrangements. The return line 164 is similarly arranged as discussed with relation to the liquid reservoir 54 or waste container 140 detailed with relation to the front end configuration.

In the back and front configuration, the second end 146B of the cylinder discharge line 144 is connected to the keg coupler 18 as disclosed previously. Attached to the spigot 36 or tower head 34 directly, is a jumper line 170 that extends from a first end 172A and the second end 172B with the first end 172A attached to a first spigot 36A or tower head 34A and the second end 172B attached to a second spigot 36B or tower head 34B. In this way, a back end configuration is completed but instead of running to the return line 164 directly, the jumper line 170 begins a front end configuration with the return line 164 connected as described with respect to the front end configuration. In this way two product lines 30 are cleaned in a single circulation.

Like the liquid inlet line 50 and the liquid discharge line 70, the air discharge line 82, the pump suction line 86, the pump discharge line 98, the pressurized liquid line 124, the relief line 136, the cylinder discharge line 144, the pressure gauge line 154, and the return line 164, have a diameter of 0.375 inches in one embodiment to match the lines typically found in dispensing installations 12. In other embodiments, the diameter is 0.500 to match another industry standard, but can be other suitable sizes based on industry standards or a particular dispensing installation 12 configuration.

Figure 6:
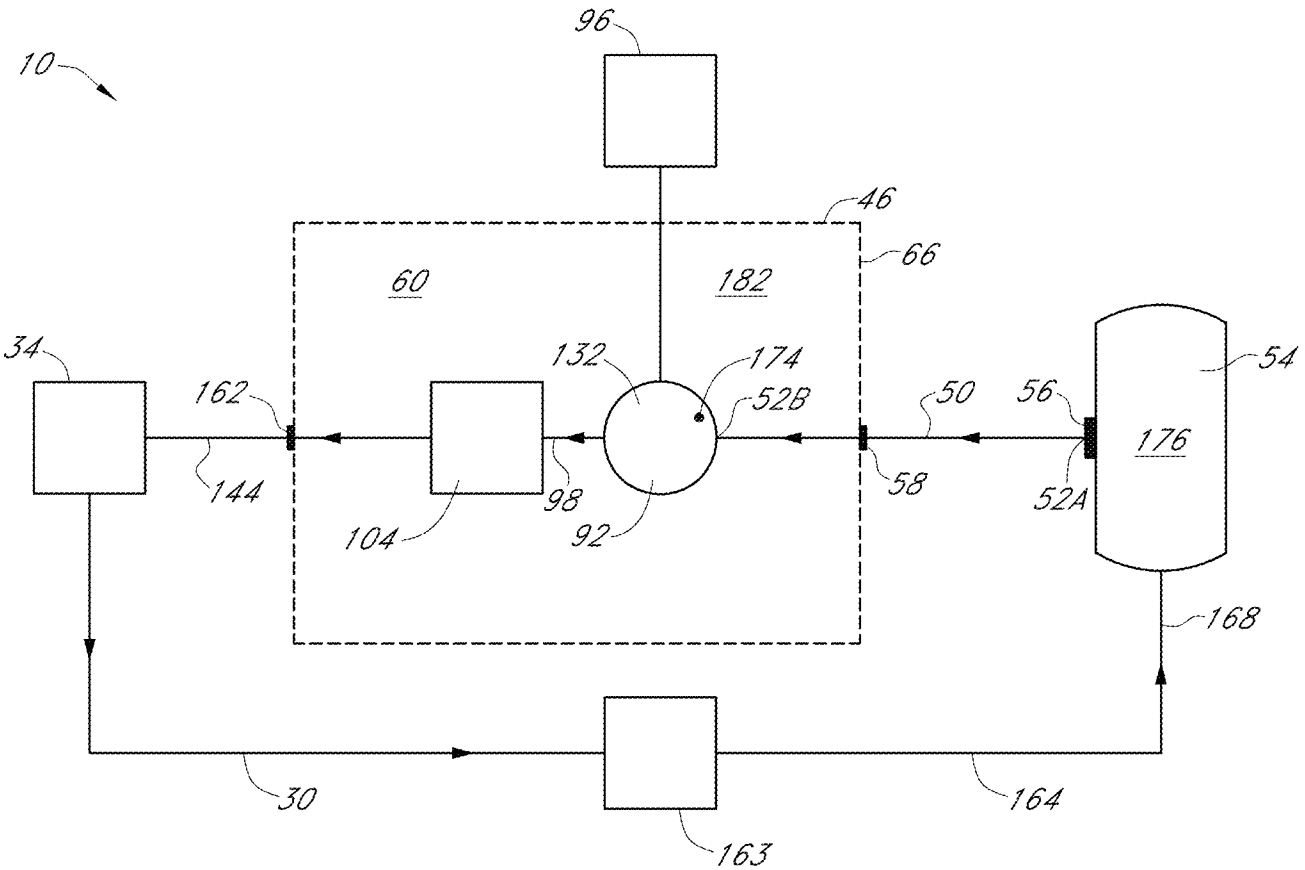
FIG. 6 is a schematic view of a system and method for cleaning and sanitizing a dispensing installation in a front end configuration.
Figure 7:
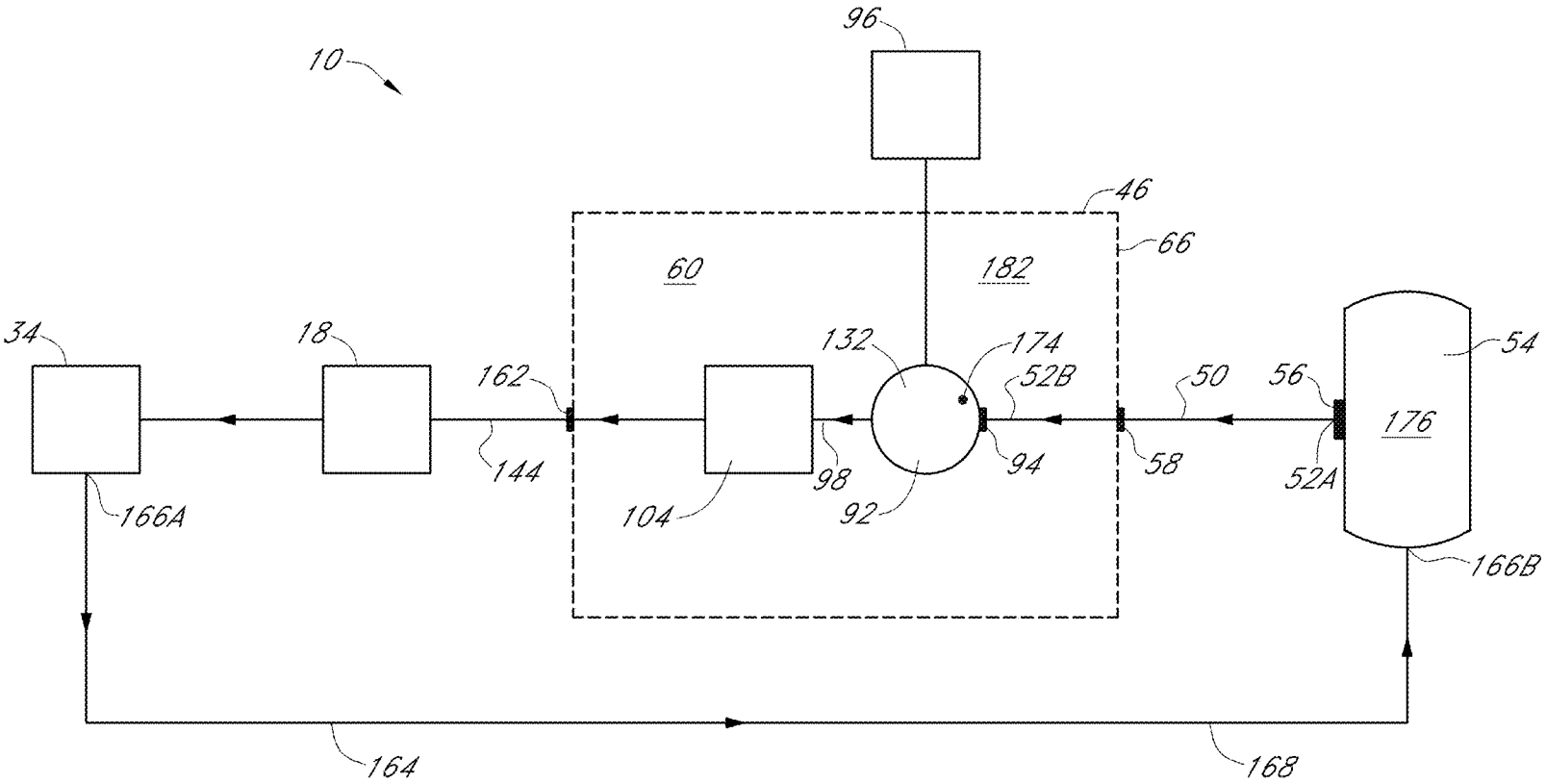
FIG. 7 is a schematic view of a system and method for cleaning and sanitizing a dispensing installation a back end configuration.
Figure 8:
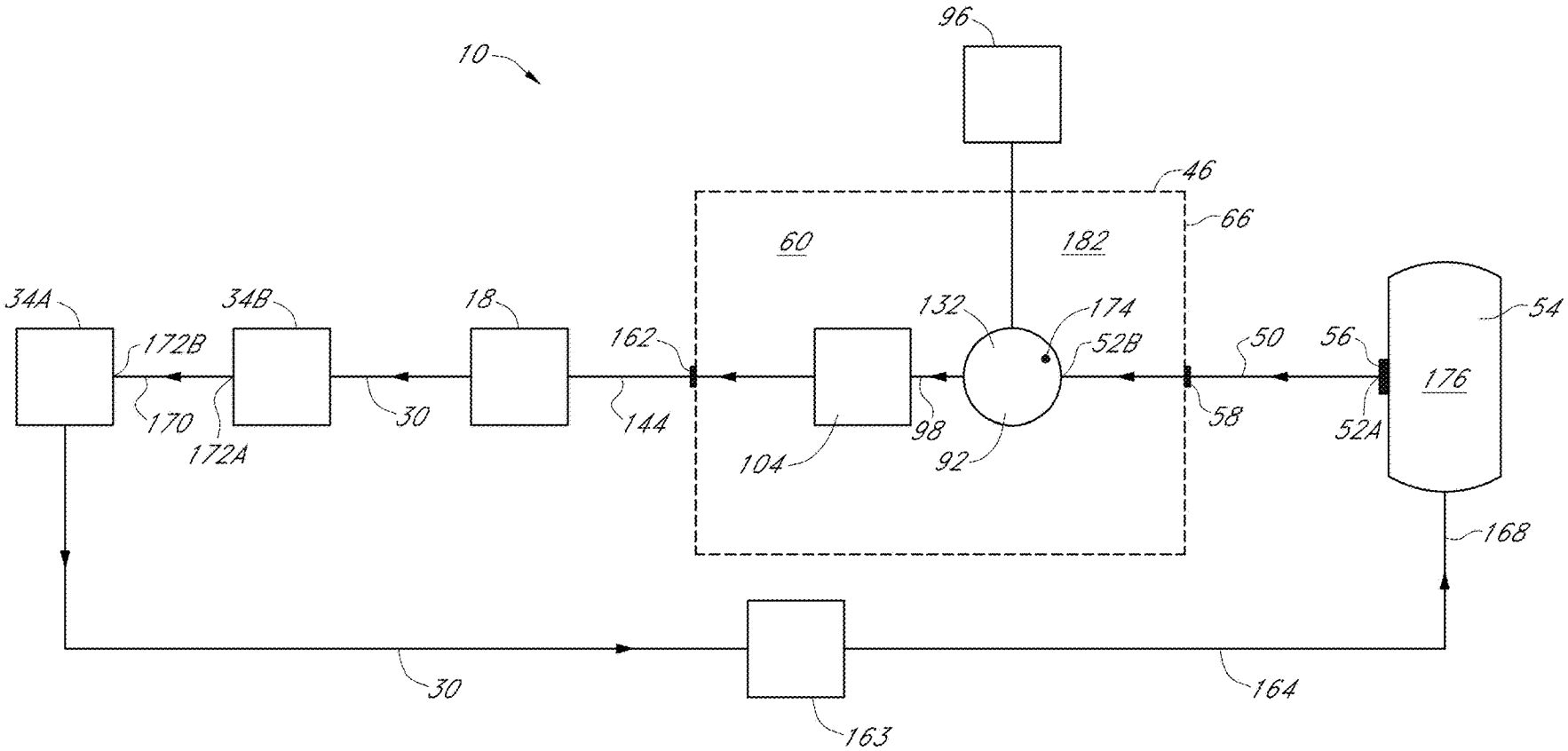
FIG. 8 is a schematic view of a system and method for cleaning and sanitizing a dispensing installation in a back and front end configuration.
Figure 9A:
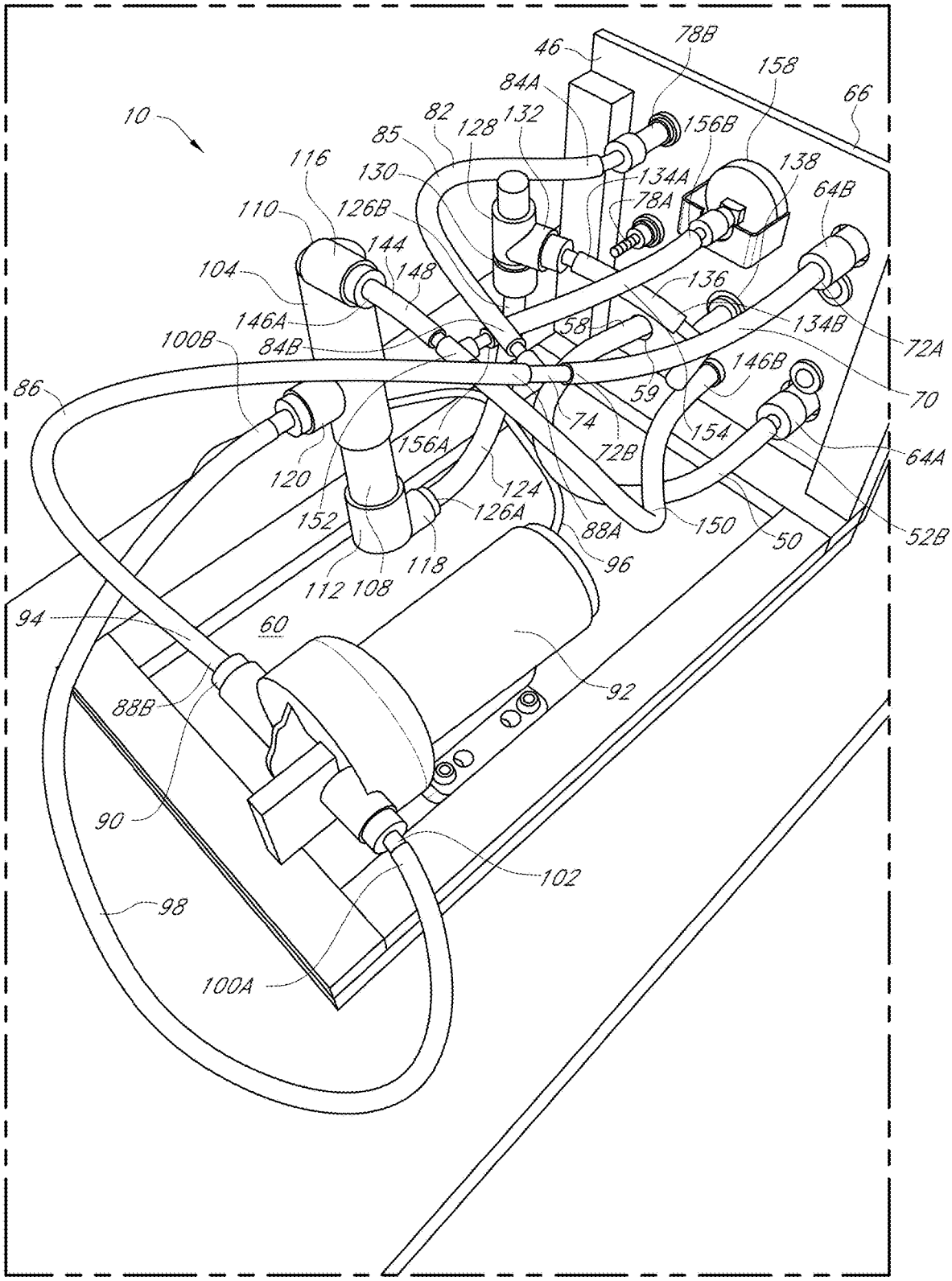
FIG. 9A is a top perspective view of a system and method for cleaning and sanitizing dispensing installation.
Figure 9B:
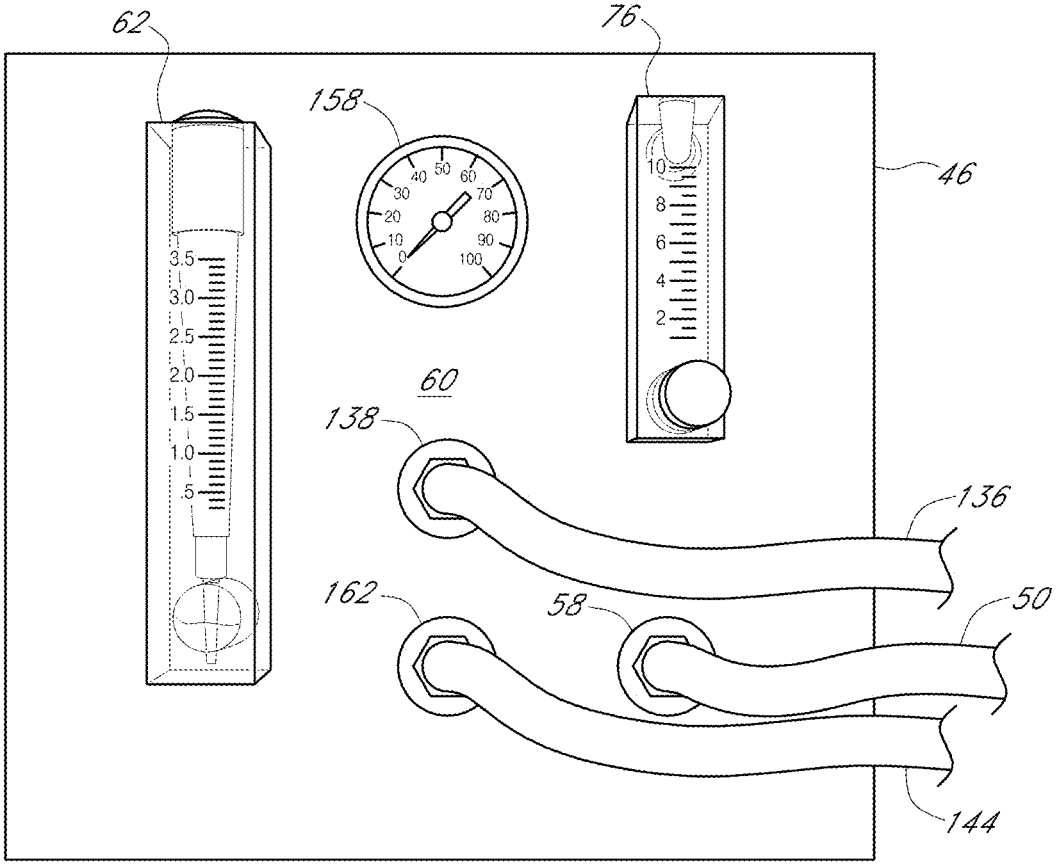
FIG. 9B is a front perspective view of a system and method for cleaning and sanitizing dispensing installation.

In an alternative embodiment of the cleaning and sanitizing system 10, the pump 92 is a 5-stage diaphragm positive displacement pump with a built in bypass 132 capable of exceeding 60 PSIG but running at 50 PSIG while pumping seven gallons per minute. Other similar pumps 92 with the aspects detailed with relation to this embodiment are contemplated as well, such as a rotatory vein positive displacement pump 92 configured to regulate pressure by varying an air flow volume allowed into the pump 92, and should not be interpreted to be strictly limited to the 5-stage diaphragm positive displacement pump 92 with a built in bypass 132 An orifice 174 is positioned through the suction side 90 of the pump 92 to directly draw in ambient or atmospheric air during operation of the pump due to the flow of liquid in the pump 92. The use of this particular pump 92 reduces the weight of the pump 92 in comparison to other pumps 92 described herein by up approximately 20 pounds, reduces noise of operation and the amount of pulsation, which is nearly eliminated, and provides for a smaller physical footprint for storage, mounting, and transporting. Additionally, one or more of the following components need not be included due to the internal pressure regulation provided for in this arrangement: liquid flow meter 62, liquid discharge line 68, first T-adapter 74, air flow meter 76, air discharge line 82, check valve 85, the bottom port 118 of the cylindrical form controller 104, pressurized liquid line 124, pressure relief valve 128, pressure relief line 136, pressure relief port 136, second T-shaped adapter 152, pressure gauge line 154, and pressure gauge 158. In the described embodiment, the liquid inlet line 50 or the pump suction line 86 draws directly from the liquid reservoir to the suction side 90 of the pump. This embodiment and variations thereof, are also configured to connect to the dispensing installation 12 in a variety of ways, including a front end configuration as exemplified in FIG. 6, a back end configuration as exemplified in FIG. 7, and in a back and front configuration as exemplified in FIG. 8, while still providing for the same advantages and benefits over the state of the art as previously described.

During operation, a cleaning solution 176 that includes water only, or is non-caustic, non-abrasive, and non-corrosive is prepared in the liquid reservoir 54 or the liquid reservoir 54 is prepared in advance and stored onsite or brought onsite during operation. Although caustic, abrasive, and corrosive cleaning solutions 176 could be used with the cleaning and sanitizing system 10, there is no need to do so.

The cleaning and sanitizing system 10 is attached to the dispensing installation by way of the tower head 34 or the spigot 36 and the product line 30 is connected to the return line connector 163 in a front end configuration; or by way of the keg coupler 18, which can be onsite or brought during operation, and the return line 164 is connected to the tower head 34 or spigot 36 in a back end configuration; or in a back and front end configuration the jumper line 170 is connected between the first tower head 34A and the second tower head 34B, or the first spigot 36A and the second spigot 36B to combine the front end configuration and back end configuration thereby allowing for the cleaning and sanitization of multiple product lines 30. During operation, the kegs 16 are removed from their respective keg coupler 18

Then, the pump 92 is connected to the power source 96 and powered on. The pump 92 pulls cleaning solution 176 from the liquid reservoir 54 to the suction port 90 of the pump 92, simultaneously consistently drawing in a source of air or gas, which is a quantity of ambient or atmospheric air 182 in the exemplary embodiment. In doing so, liquid is pulled through the liquid inlet line 50 and into the liquid flow meter 62, which regulates the liquid flow. The flow meter 62 is monitored and controlled onsite or by the remote device 160. The cleaning solution 176 is then discharged from the liquid flow meter 62 into the liquid discharge line 70, which is combined with the ambient air 182 at the first T-adapter 74. The ambient air 182 is added but does not add energy to the overall flow of the cleaning and sanitizing system 10. As the ambient air 182 is pulled in, it passes through the air flow meter 76 that monitors and controls the flow of air which can be controlled onsite or by the remote device 160.

In some embodiments, the source of air or gas is not ambient air 182, but is gas or air that is injected in measured pressurized amounts, which expands until it equalizes to the pressure of the overall cleaning and sanitizing system 10. However, when this approach is taken, more control is necessary over the flow of gas or air to meet applicable safety guidelines, while adding unnecessary cost. Upon discharge, the flow is a mixture of gas and liquid for the first time as the air 182 and the cleaning solution 176 meet for the first time as a turbulent mixture inside the first T-shaped adapter 74 and are pulled into the pump 92 through the suction port 90.

During this stage of operation, the air 182 and cleaning solution 176 are combined in substantially equal ratios of air to liquid necessary for proper operation. For instance, a 2:1 ratio or 1:1 ratio of air to liquid is contemplated. This is counter-intuitive to mist flow or droplet flow systems that require high air velocity at very high air to liquid ratios up to 6000:1 to achieve randomized instances of mechanical action.

Once inside the pump 92, the mixture is pressurized up to 60 PSIG. The pressurized mixture is then discharged through the discharge port 102 of the pump 92 through the pump discharge line 98 and into the elongated body 106 of the cylindrical form controller 104 through the inlet port 120.

In an alternative embodiment, the source of air or gas 182 is drawn in by cleaning solution 176 being discharged through the discharge line 98 that is connected after the discharge port 102. This is possible due to the velocity of the cleaning solution 176 that draws in ambient air 182 as the cleaning solution 176 passes through the T-shaped adapter 74. The use of the air flow meter 76 also for consistent addition from the source of air or gas 182.

Figure 10A:
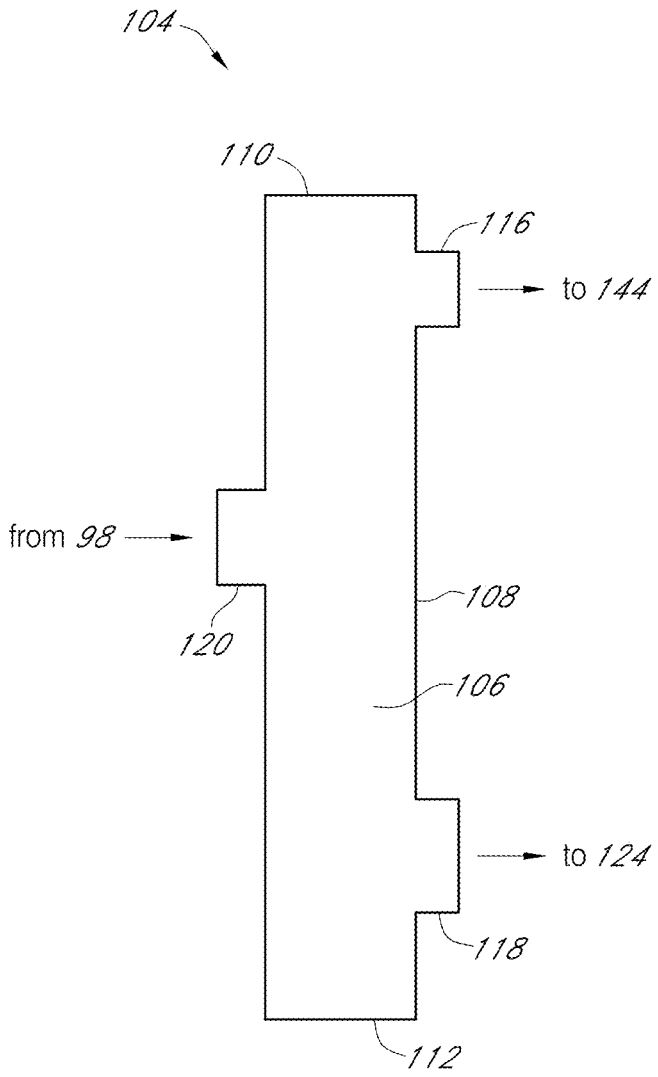
FIG. 10A is a side view of a cylindrical flow controller.
Figure 10B:
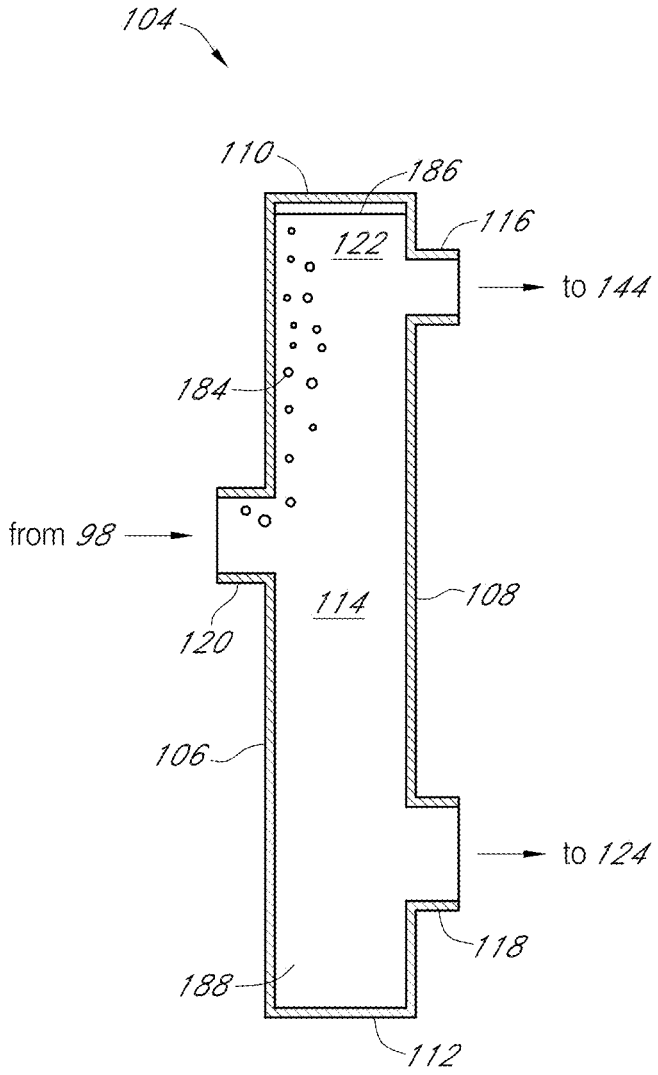
FIG. 10B is a cross-section view of a cylindrical flow controller during liquid cylinder formation.
Figure 10C:
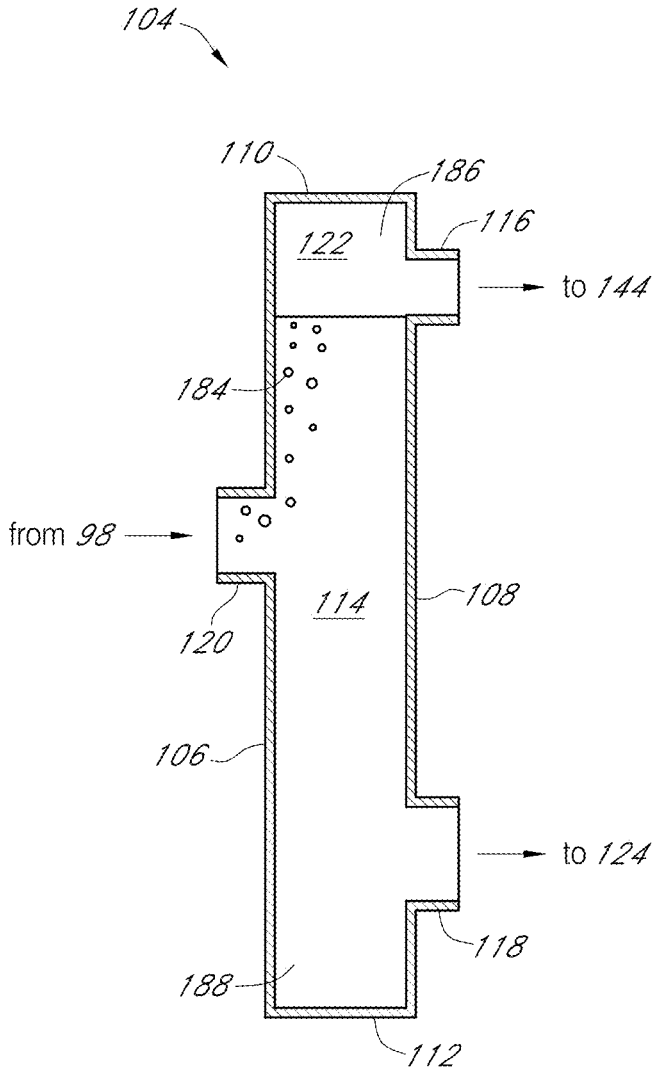
FIG. 10C is a cross-section view of a cylindrical flow controller during air cylinder formation.
Figure 11A:
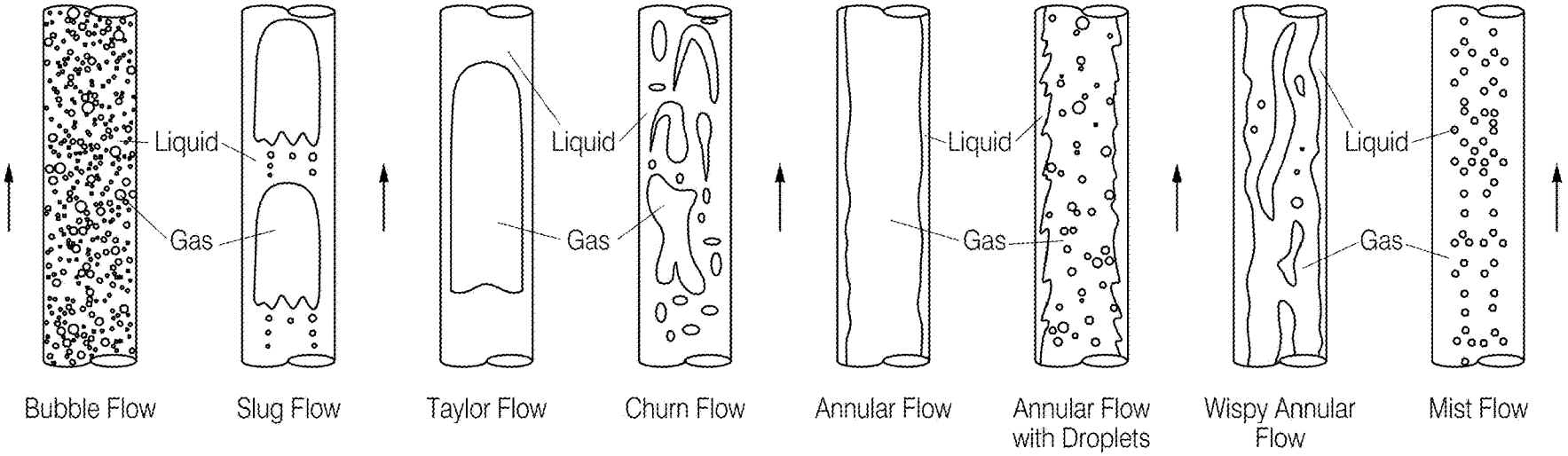
FIG. 11A is a cross-section view of mixed-phase flows flowing in a vertical direction.
Figure 11B:
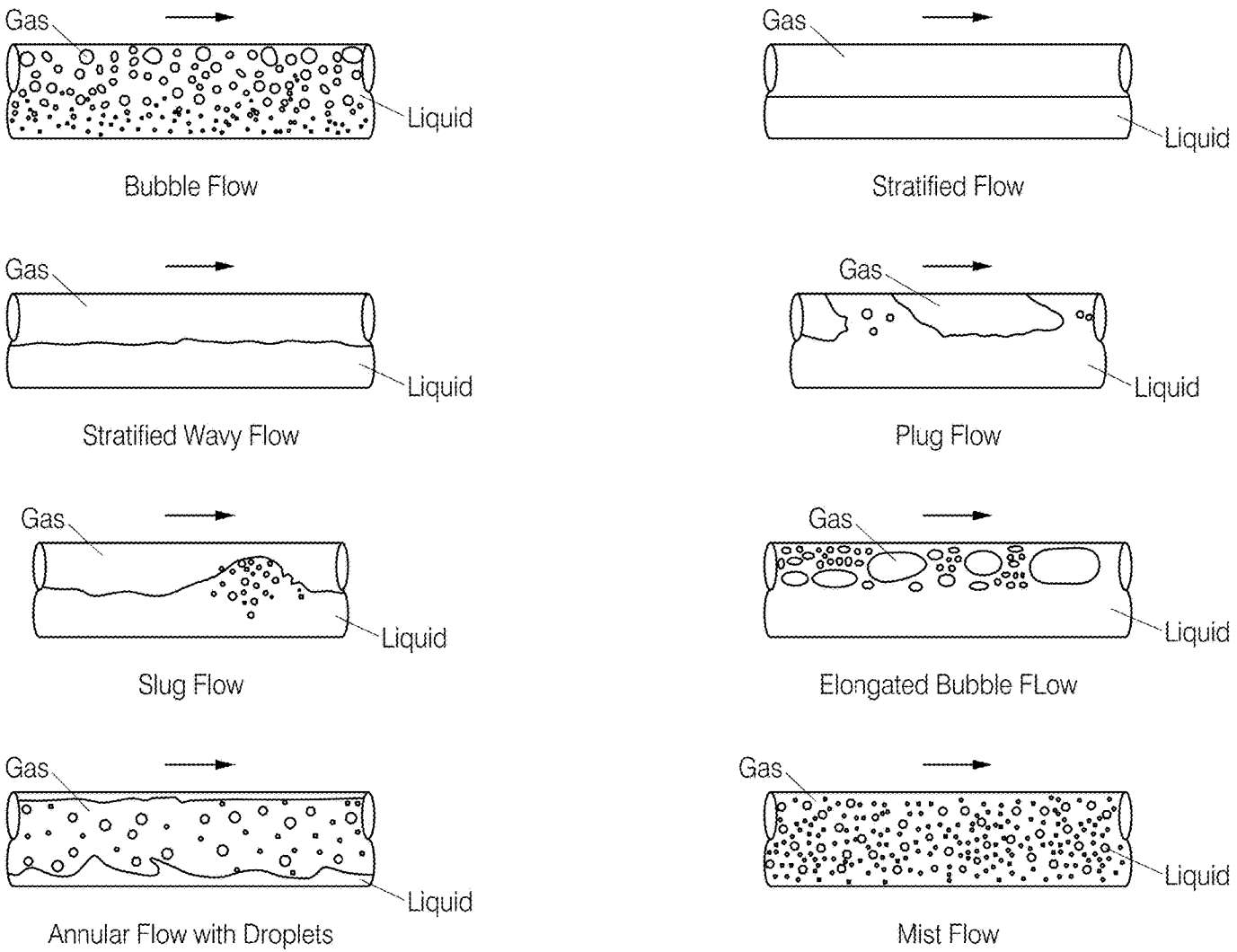
FIG. 11B is a cross-section view of mixed-phase flows flowing in a horizontal direction.

As seen in FIGS. 10A to 10C, the diameter of the elongated body 106 is greater than that of the pump discharge line 98, as well as the other lines described herein. In an exemplary embodiment, the diameter of the body is approximately 1.5 inches to 3.0 inches compared to the 0.375 inch diameter of the pump discharge line 98. Although the diameter of the elongated body 106 is greater, the diameter is not excessive larger to avoid excessive bulking that reduces cleaning and sanitizing efficiency, which will be apparent from the additional detail provided herein.

Upon entry of the pressurized mixture into the cylindrical form control 104, the pressurized mixture has a reduction in velocity due to the change in diameter. This in turn provides for air bubbles 184 in the pressurized mixture to separate and rise from the liquid. The air bubbles 184 travel upwards due to buoyancy and gravity into the headspace 122 of the elongated body 106 to form a large air mass 186. For proper collection in the headspace 122, the elongated body 106 must be upright or substantially upright so that the top 110 of the elongated body 106 is above the bottom 112. Additionally, the slow down dampens or removes any pulsations from the pump 92 that could inhibit the cleaning and sanitizing process due to disruptions in uniformity and consistency. Pulsation is further dampened by the pressure exerted that compresses the large mass of air 186. Also, the cleaning solution 176 of the pressurized mixture separates into a large liquid mass 188 below the headspace 122 such that only liquid is adjacent the bottom 112 of the elongated body 106. The size of the cylindrical flow controller 104 provides the necessary time to all this separation to occur.

As additional pressurized mixture is pumped into the elongated body 106, cylinders of liquid or cleaning solution 190 and cylinders of air or gas 192 are discharged out of the cylinder outlet 116 and into the cylinder discharge line 144. More particularly and as seen in FIGS. 10A to 10C, as the air 182 and the cleaning solution 176 separate, the liquid cylinder 190 is initially discharged due to the lack of ambient air in the headspace 122. As air 182 continues to accumulate in the headspace 122, the large air mass 186 becomes large enough that it extends to the cylinder outlet 116 and the cylinder of air 192 is discharged. This process is rapidly and consistently repeated as the pressurized mixture is constantly pumped into the cylindrical flow controller 104, which is positioned after the discharge port 102 of the pump 92. Without the headspace 122 above the cylinder outlet 116 a slug, plug, annular flow, or other mixed-phase flow would occur and not the alternating flow of liquid cylinders 190 and air cylinders 192.

The alternating flow of liquid cylinders 190 and air cylinders 192 (alternatively referred to as a dynamic shear flow) flows in substantially the same manner regardless of orientation, including in a horizontal and vertical flow, including a upwards and downwards vertical flow. The flow is not disrupted at choke points or elbows that are typically found in dispensing installations 12 as product lines 30 go over, up, down, and through walls 38. Similarly, the flow is maintained even in curves and bends.

Unlike air bubbles 184, the air cylinder 192 is compressed and squeezed by liquid cylinders 190 on opposite ends. This causes the air cylinder 192 to be pushed to an annular interior surface 194 of the product line 30. This means that air is in direct contact with the product line 30, including any restrictions 196 (not shown) that may be present. Necessarily, the air cylinder 192 eliminates the presence of any boundary layer or laminar sublayer that may be present.

The liquid cylinder 190 is formed by the pump 92 exerting pressure from behind the cleaning solution 176, which is also subjected to the static pressure of the product line 30. Unlike mixed flows, the liquid cylinder 190 contacts the complete annular interior surface 194 of the product line 30, like the air cylinder 192, including restrictions 196 where present. Unlike a conventional liquid flow, as the liquid cylinder 190 follows the air cylinder 192 that has removed the boundary layer and laminar sublayer that would normally drag on the hydrodynamic entry region 198 causing the formation of the fully developed region, which includes the boundary layer and laminar sublayer. As a result, the hydrodynamic entry region 198 condition is continuously present in the liquid cylinder 190 throughout circulation regardless of direction, orientation, and changes in direction, orientation, or both.

Figure 12A:
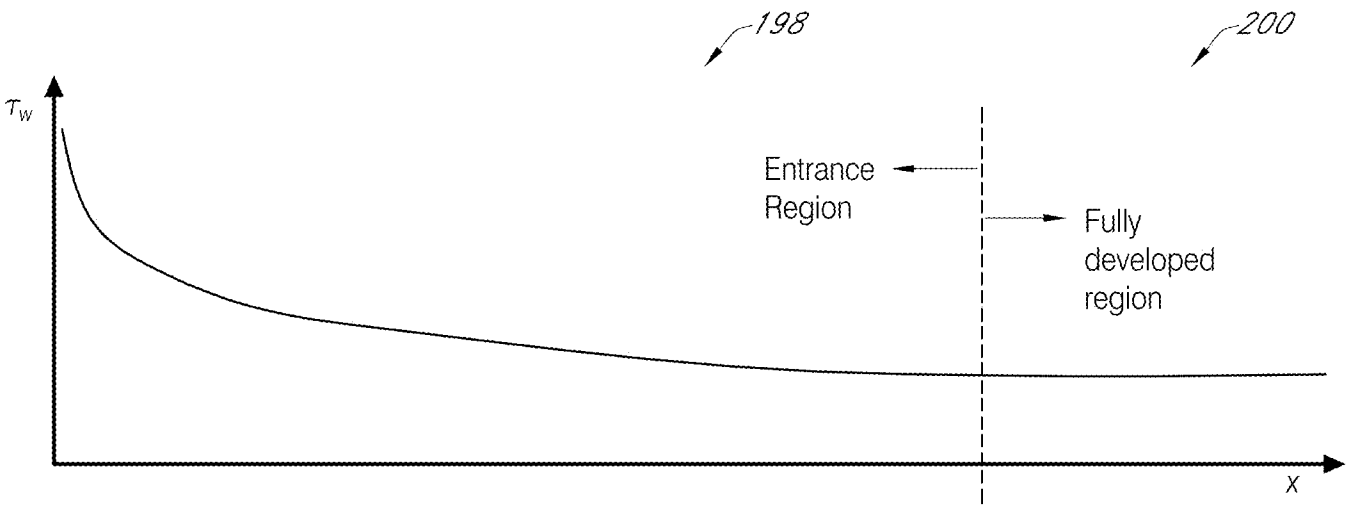
FIG. 12A is a diagram of a liquid flow profile.
Figure 12B:
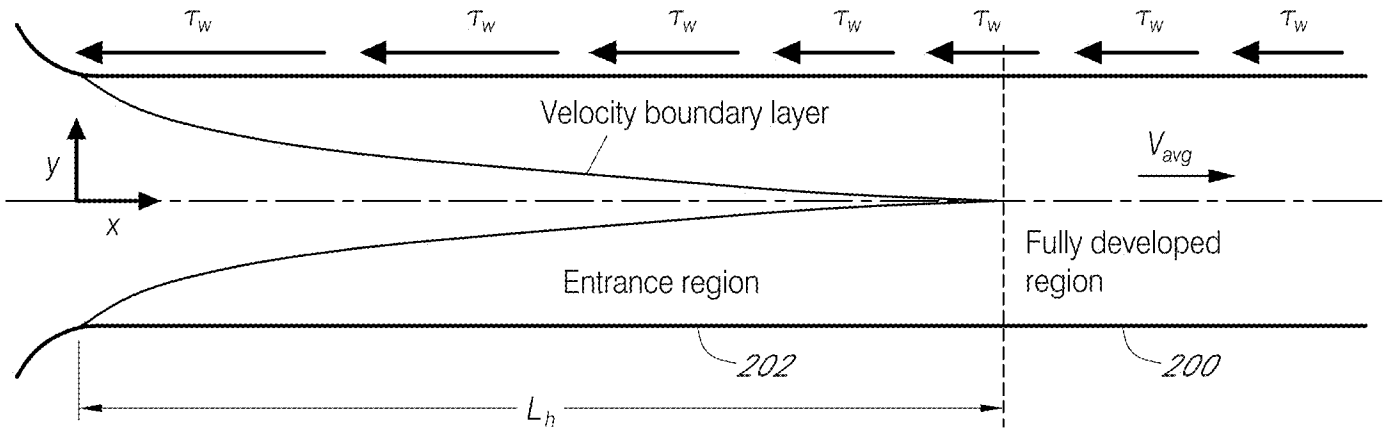
FIG. 12B is a diagram of a liquid flow profile
Figure 12C:
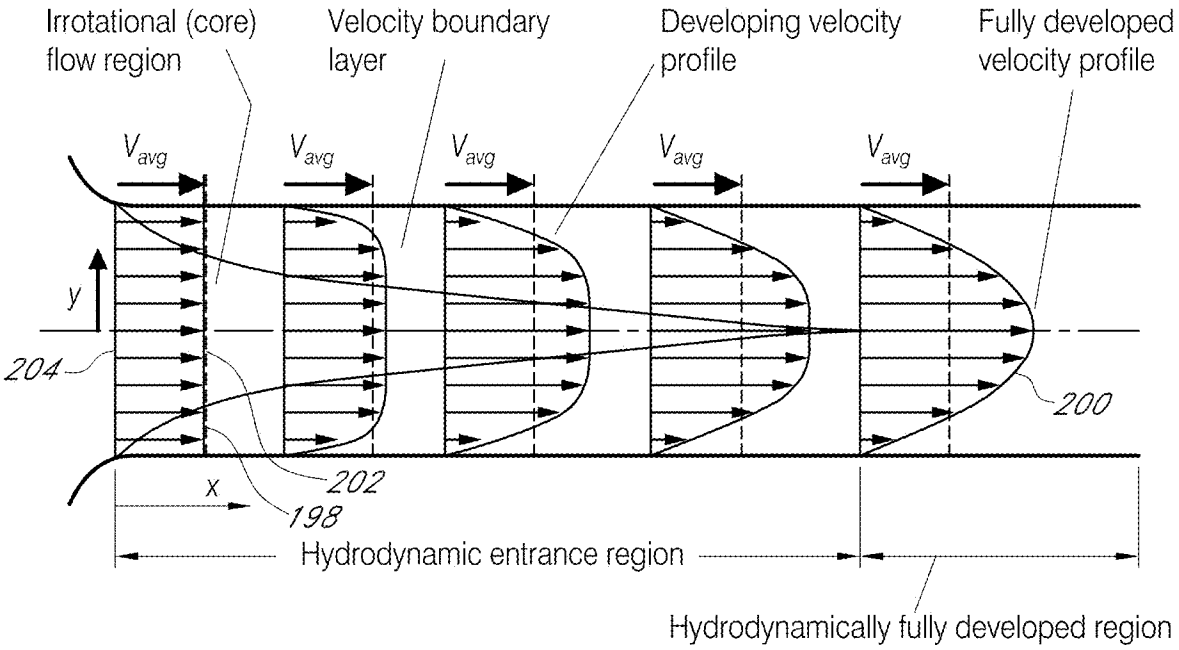
FIG. 12C is a diagram of a liquid flow profile.
Figure 13:
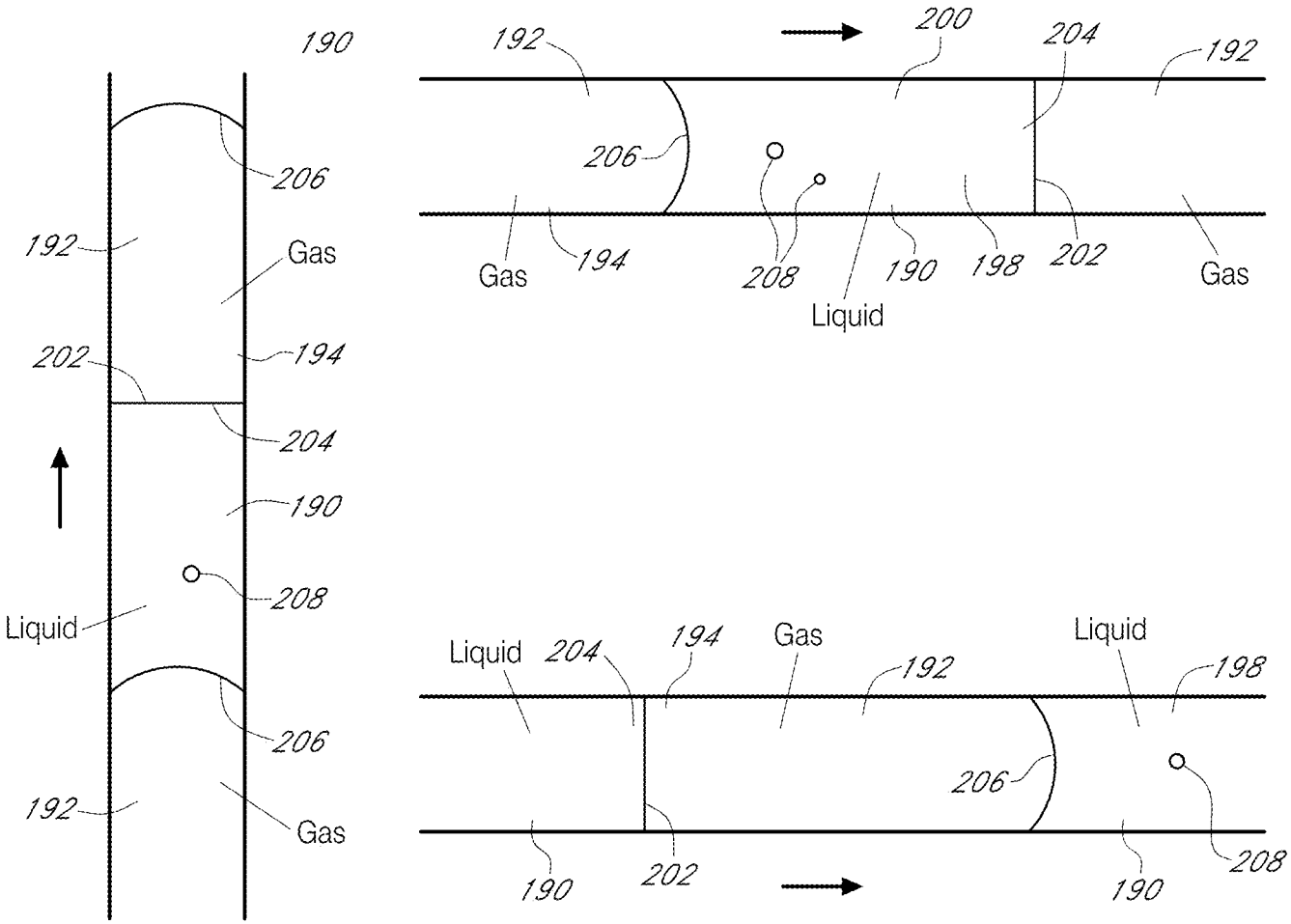
FIG. 13 are cross-section views of an alternating cylindrical flow.

Further, by alternating liquid cylinders 190 and air cylinders 192, the liquid cylinder 190 is prevented from transitioning to the fully developed region 200 away from a lead surface 202 of the liquid cylinder 190 that is present in liquid flows—which is why liquid flows are characterized with having a parabolic lead surface 202 as seen in FIG. 12C. Instead, the absence of the boundary layer or laminar sublayer allows for the hydrodynamic entry region to be maintained, which is apparent as seen in FIGS. 12 and 13 that show the lead surface 202 of the liquid cylinder 192 has a substantially flat profile associated with an irrotational core flow region 204 of the hydrodynamic entry region 198. Also, a rear surface 206 of the liquid cylinder 190 has a slight parabolic or turbulent shape demonstrating that minimal drag is present but still within the hydrodynamic entry region 198. However, the distance between liquid cylinders 190 and air cylinders 192 is such that there is insufficient length for the drag to cause formation of the fully developed region 200 as there is a constant push from another liquid cylinder 190 that maintains the desired flow of the liquid cylinder 190 and the integrity of the air cylinder 192.

Because the boundary layer and laminar sublayer are absent, the interior surface 194 of the product line 30 is exposed to uninhibited contact from the hydrodynamic entry region, which applies a maximum shear force up to 100 fold higher than other methods are capable of producing during circulation. As a result, the liquid cylinder 190 mechanically acts on the complete interior surface 194 of the product line, essentially scouring the product line 30 upon contact. By controlling this profile of the liquid cylinder 190, maximum shear force is obtained without the need for high magnitudes of velocity set forth in mist flow and droplet flow systems because of the inherent shear force present at the hydrodynamic entry region.

As contaminants, including beer stone and other biofilms 208, are cleaned from the interior surface 194, the liquid cylinder 190 entraps the contaminants and carries them out of the product line 30, thereby sanitizing the product line 30. Also, because there is no slippage present with the air cylinder 192, contaminants are not protected by the laminar sublayer from being carried out by the liquid cylinders 190, which stops recolonization.

During operation, the alternating flow of liquid cylinders 190 and the air cylinders 192 are circulated through the dispensing installation 12 as detailed previously with the product line 30 being mechanically worked upon thousands of times during a cleaning cycle, which is only fifteen minutes in some implementations. As such, the flow is repeatable and reliable while applying maximum shear force constantly during the cleaning cycle.

In the event that the pressure during operation exceeds the industry standard of 60 PSIG, the liquid mass 186 at the bottom 112 of the cylindrical form controller 104 is relieved through the pressure relief valve 128, which in some embodiments is then recirculated. The system pressure can be monitored by the pressure gauge 158 onsite, on the remote device 160, or by way of a pressure switch 161 (not shown).

In some circumstances, the cleaning solution 176 is used in conjunction with the cleaning and sanitizing system 10. Unlike other cleaning solutions, the inventive cleaning solution 176 is non-corrosive, non-caustic, and non-abrasive. The cleaning solution 176 is prepared from a first container 178 (not shown) that contains hydrogen peroxide and a food-grade EDTA or sodium citrate—the combination of which is stable for later dilution without the problem of having solids present. More particularly, the hydrogen peroxide has a concentration of 29% by volume. A second container 180 (not shown) contains an alkaline solution. The contents of the first container 178 and the second container 180 are combined in the liquid reservoir 54 and diluted so that the hydrogen peroxide has a concentration of 2% to 3% by volume and the overall pH is between 9 and 11. The use of the cleaning solution 176 is only possible due to the mechanical action of cleaning and sanitizing system 10, which would otherwise not be sufficiently abrasive, corrosive, or caustic. As such, rather than using multiple corrosive and harsh chemical solutions with strong acids or alkali that are potentially life-threatening during a multi-step cleaning process, the present invention provides for the cleaning solution 176, which although not ingestible can make contact with human tissue, and not cause burns, i.e., the cleaning solution 176 could be gargled much like gargling 2 to 3% hydrogen peroxide. The use of the cleaning solution 176, at most, extends the cleaning process to include a brief rinsing step.

Therefore, a cleaning and sanitizing system 10 and associated method has been provided that provides mechanical cleaning action capable of removing contaminants, including beer stone, maintains the hydrodynamic entry region throughout circulation, as well as the related shear force in a continuous and persistent manner, that is not a mixed flow but an alternating flow system of liquid and air cylinders, provides a device to alter mixed flow into distinct cylinders of liquid and air, provides mechanical action in horizontal and vertical flows, regardless of flow action, including through transitions in a product line, that does not require forced air or gas, or energy from air or gas, that utilizes ambient or atmospheric air, that is a single-step process for cleaning, that does not use caustic solutions and other potentially life-threatening compositions, that works on a single product line from a front end or back end, or on multiple lines, that is quiet, safe, lightweight, potentially mobile, cost effective, and easy to use, that maintains beer quality and safety, and improves upon the art.

From the above discussion and accompanying figures and claims it will be appreciated that the cleaning and sanitizing system 10 and method offers many advantages over the prior art. It will be appreciated further by those skilled in the art that various other modifications could be made to the device without parting from the spirit and scope of this invention—including implementation into other fields of endeavor, such as industrial applications like chemical transport, agricultural applications like feed transport, and commercial applications like car washes. All such modifications and changes fall within the scope of the claims and are intended to be covered thereby. It should be understood that the examples and embodiments described herein are for illustrative purposes only and that various modifications or changes in the light thereof will be suggested to persons skilled in the art and are to be included in the spirit and purview of this application.

What is claimed is:

1. A system for cleaning and sanitizing a dispensing installation, comprising:

a pump having a suction side and a discharge side;

a liquid reservoir connected to the suction side of the pump;

a cylindrical flow controller having an inlet port and a cylinder outlet port, wherein the inlet port is connected to the discharge side of the pump;

a source of gas in communication with discharge side of the pump configured to provide a mixed phase of liquid and gas; and a product line connected to the cylinder outlet port, wherein the cylindrical flow controller is configured to produce an alternating flow of cylindrical gas and cylindrical liquid through the cylinder outlet port.

2. The system of claim 1 further comprising an air discharge line connected between the suction side of the pump and the source of gas.

3. The system of claim 2 further comprising a liquid discharge line connected between the suction side of the pump and the source of liquid.

4. The system of claim 3 further comprising the air discharge line connected to an air flow meter at an end opposite the pump, and the liquid air discharge line connected to a liquid flow meter at an end opposite the pump.

5. The system of claim 1 further comprising the pump having an orifice through the suction side that is configured to draw in the source of gas.

6. The system of claim 5 further comprising a liquid discharge line connected between the suction side of the pump and the source of liquid.

7. The system of claim 1 wherein the source of gas is ambient air.

8. The system of claim 1 further comprising the cylindrical flow controller having an elongated body that extends from a top to a bottom with a sidewall therebetween, which form an internal cavity.

9. The system of claim 8 further comprising the internal cavity having a head space positioned between the top of the elongated body and the cylinder outlet port.

10. The system of claim 8 further comprising the cylindrical flow controller having a pressurized liquid outlet adjacent the bottom of the elongated body and an inlet port between the cylinder outlet port and the pressurized liquid outlet.

11. The system of claim 10 further comprising a pressurized liquid line connected between the pressurized liquid outlet and a pressure relief valve.

12. The system of claim 1 further comprising a cylinder discharge line connected to the cylinder outlet port and configured to be connected to a product line of the dispensing installation.

13. The system of claim 1 further comprising a pump discharge line connected to the discharge side of the pump and the cylindrical form controller, wherein a diameter of the pump discharge line is less than a diameter of an internal cavity of the cylindrical form controller between a sidewall.

14. The system of claim 1 wherein the pump is the only pump.

15. The system of claim 1 wherein the liquid reservoir contains a cleaning solution having a pH between 9 and 11, and between 2% and 3% hydrogen peroxide by volume.

16. The system of claim 1 wherein the cylindrical gas of the alternating flow of cylindrical gas and cylindrical liquid is compressed and squeezed by the cylindrical liquid of the alternating flow of cylindrical gas and cylindrical liquid at opposing ends such that the cylindrical gas is pushed to an annular interior surface of a product line thereby removing the presence of a boundary layer and a laminar sublayer, and the cylindrical liquid have a hydrodynamic entry region that is maintained throughout circulation.

17. A cylindrical flow controller, comprising:

an elongated body that extends from a top to a bottom with a sidewall therebetween, which forms an internal cavity;

a head space positioned between the top of the elongated body and a cylinder outlet port in the sidewall; and a pressurized liquid outlet adjacent the bottom of the elongated body and an inlet port between the cylinder outlet port and the pressurized liquid outlet.

18. A method of cleaning and sanitizing a dispensing installation, comprising:

providing a mixed phase flow of liquid and gas;

circulating an alternating flow of cylindrical gas and cylindrical liquid from the mixed phase flow of liquid and gas;

eliminating the presence of a boundary layer and a laminar sublayer in a product line of the cylindrical air; and mechanically cleaning an annular interior surface of the product line with the cylindrical liquid.

19. The method of claim 18 further comprising the step of the alternating flow cylindrical gas and cylindrical liquid compressing and squeezing opposing ends of the cylindrical gas with the cylindrical liquid, such that the cylindrical gas is pushed to the annular interior surface of the product line during the step of circulating the alternating flow of cylindrical gas and cylindrical liquid.

20. The method of claim 19 wherein the step of mechanically cleaning is accomplished by a hydrodynamic entry region that is maintained during the step of circulating the alternating flow of cylindrical gas and cylindrical liquid.

* * * * *